US007842628B2

(12) United States Patent
Yasui et al.

(10) Patent No.: US 7,842,628 B2
(45) Date of Patent: Nov. 30, 2010

(54) WOVEN OR KNITTED FABRIC CONTAINING TWO DIFFERENT YARNS AND CLOTHING COMPRISING THE SAME

(75) Inventors: Satoshi Yasui, Osaka (JP); Seiji Mizohata, Matsuyama (JP); Takeshi Yamaguchi, Osaka (JP); Kengo Tanaka, Ibaraki (JP)

(73) Assignee: Teijin Fibers Limited, Osaka (JP)

( * ) Notice: Subject to any disclaimer, the term of this patent is extended or adjusted under 35 U.S.C. 154(b) by 254 days.

(21) Appl. No.: 10/552,826

(22) PCT Filed: Jun. 17, 2004

(86) PCT No.: PCT/JP2004/008904

§ 371 (c)(1),
(2), (4) Date: Oct. 7, 2005

(87) PCT Pub. No.: WO2004/113601

PCT Pub. Date: Dec. 29, 2004

(65) Prior Publication Data

US 2006/0223400 A1 Oct. 5, 2006

(30) Foreign Application Priority Data

| | | |
|---|---|---|
| Jun. 23, 2003 | (JP) | 2003-177763 |
| Oct. 23, 2003 | (JP) | 2003-363176 |
| Dec. 3, 2003 | (JP) | 2003-404302 |
| Mar. 19, 2004 | (JP) | 2004-080380 |

(51) Int. Cl.

| | |
|---|---|
| ***D03D 15/00*** | (2006.01) |
| ***D04B 1/14*** | (2006.01) |
| ***D03D 25/00*** | (2006.01) |
| ***D04B 1/00*** | (2006.01) |

(52) U.S. Cl. ..... 442/197; 442/181; 442/189; 442/199; 442/304; 442/310

(58) Field of Classification Search ..... 442/301, 442/304–319, 181–217; 66/170–202
See application file for complete search history.

(56) References Cited

U.S. PATENT DOCUMENTS 4,341,096 A * 7/1982 Safrit et al. ..... 66/185

(Continued)

FOREIGN PATENT DOCUMENTS

CN 1294643 A 5/2001

(Continued)

OTHER PUBLICATIONS

"Polyesters" by Horst Kopnick posted online Jun. 15, 2000 in Ullmann's Encyclopedia of Industrial Chemistry, Wiley InterScience.*

*Primary Examiner*—Rena L Dye
*Assistant Examiner*—Jennifer Steele
(74) *Attorney, Agent, or Firm*—Sughrue Mion, PLLC

(57) ABSTRACT

A woven or knitted fabric, formed from two types of yarns different in self-elongating property upon absorbing water and capable of facilitating the air-permeability when wetted with water, is constituted so that a ratio A/B of a mean length A of yarns (1) having a high water-absorbing, self-elongating property to a mean length B of yarns (2) arranged in the same direction as that of the yarn (1) and having a lower water-absorbing, self-elongating property than that of the yarn (1) is adjusted to 0.9 or less.

21 Claims, 9 Drawing Sheets

U.S. PATENT DOCUMENTS

| | | | | |
|---|---|---|---|---|
| 4,500,679 | A * | 2/1985 | DuFour | 525/64 |
| 4,733,546 | A * | 3/1988 | Toda | 66/202 |
| 5,095,548 | A * | 3/1992 | Chesebro, Jr. | 2/239 |
| 6,403,216 | B1 * | 6/2002 | Doi et al. | 428/364 |
| 6,756,329 | B1 * | 6/2004 | Umino et al. | 442/181 |
| 6,767,850 | B1 * | 7/2004 | Tebbe | 442/76 |
| 6,770,579 | B1 * | 8/2004 | Dawson et al. | 442/181 |
| 2003/0056553 | A1 * | 3/2003 | Yamazaki et al. | 66/171 |

FOREIGN PATENT DOCUMENTS

| | | | |
|---|---|---|---|
| JP | 03-213518 | A | 9/1991 |
| JP | 5-311567 | A | 11/1993 |
| JP | 6-200438 | A | 7/1994 |
| JP | 8-232133 | A | 9/1996 |
| JP | 8-325874 | A | 12/1996 |
| JP | 10-077544 | A | 3/1998 |
| JP | 2002-180323 | A | 6/2002 |
| JP | 2003-041462 | A | 2/2003 |
| JP | 2003-082543 | A | 3/2003 |
| JP | 2003-82555 | A | 3/2003 |
| JP | 2003-239101 | A | 8/2003 |
| JP | 2003-293234 | A | 10/2003 |
| JP | 2005-23431 | A | 1/2005 |

* cited by examiner

Fig. 8

| | C | D | C | D | C | D | C | D | C | D | C | D | C | D | C | D | C | D | C | D | C | D | C | D | C | D | C | D | |
|---|---|---|---|---|---|---|---|---|---|---|---|---|---|---|---|---|---|---|---|---|---|---|---|---|---|---|---|---|---|
| 24 | × | | × | | × | | × | | × | | × | | × | | × | | × | | × | | × | | × | | × | | × | | b |
| 23 | | ○ | ¥ | ○ | | ○ | ¥ | ○ | | ○ | ¥ | ○ | | ○ | ¥ | ○ | | ○ | ¥ | ○ | | ○ | ¥ | ○ | | ○ | | ○ | b |
| 22 | × | | × | | × | | × | | × | | × | | × | | × | | × | | × | | × | | × | | × | | × | | b |
| 21 | ¥ | ○ | | ○ | ¥ | ○ | | ○ | ¥ | ○ | | ○ | ¥ | ○ | | ○ | ¥ | ○ | | ○ | ¥ | ○ | | ○ | ¥ | ○ | | ○ | b |
| 20 | × | | × | | × | | × | | × | | × | | × | | × | | × | | × | | × | | × | | × | | × | | b |
| 19 | | ○ | ¥ | ○ | | ○ | ¥ | ○ | | ○ | ¥ | ○ | | ○ | ¥ | ○ | | ○ | ¥ | ○ | | ○ | ¥ | ○ | | ○ | | ○ | b |
| 18 | × | | × | | × | | × | | × | | × | | × | | × | | × | | × | | × | | × | | × | | × | | b |
| 17 | ¥ | ○ | | ○ | ¥ | ○ | | ○ | ¥ | ○ | | ○ | ¥ | ○ | | ○ | ¥ | ○ | | ○ | ¥ | ○ | | ○ | ¥ | ○ | | ○ | b |
| 16 | × | | × | | × | | × | | × | | × | | × | | × | | × | | × | | × | | × | | × | | × | | b |
| 15 | | ○ | ¥ | ○ | | ○ | ¥ | ○ | | ○ | | ○ | | ○ | | ○ | | ○ | | ○ | | ○ | | ○ | | ○ | | ○ | a |
| 14 | × | | × | | × | | × | | × | | × | | × | | × | | × | | × | | × | | × | | × | | × | | b |
| 13 | ¥ | ○ | | ○ | ¥ | ○ | | ○ | | ○ | | ○ | | ○ | | ○ | | ○ | | ○ | | ○ | | ○ | | ○ | | ○ | a |
| 12 | × | | × | | × | | × | | × | | × | | × | | × | | × | | × | | × | | × | | × | | × | | b |
| 11 | | ○ | ¥ | ○ | | ○ | ¥ | ○ | | ○ | | ○ | | ○ | | ○ | | ○ | | ○ | | ○ | | ○ | | ○ | | ○ | a |
| 10 | × | | × | | × | | × | | × | | × | | × | | × | | × | | × | | × | | × | | × | | × | | b |
| 9 | ¥ | ○ | | ○ | ¥ | ○ | | ○ | | ○ | | ○ | | ○ | | ○ | | ○ | | ○ | | ○ | | ○ | | ○ | | ○ | a |
| 8 | × | | × | | × | | × | | × | | × | | × | | × | | × | | × | | × | | × | | × | | × | | b |
| 7 | | ○ | ¥ | ○ | | ○ | ¥ | ○ | | ○ | | ○ | | ○ | | ○ | | ○ | | ○ | | ○ | | ○ | | ○ | | ○ | a |
| 6 | × | | × | | × | | × | | × | | × | | × | | × | | × | | × | | × | | × | | × | | × | | b |
| 5 | ¥ | ○ | | ○ | ¥ | ○ | | ○ | | ○ | | ○ | | ○ | | ○ | | ○ | | ○ | | ○ | | ○ | | ○ | | ○ | a |
| 4 | × | | × | | × | | × | | × | | × | | × | | × | | × | | × | | × | | × | | × | | × | | b |
| 3 | | ○ | ¥ | ○ | | ○ | ¥ | ○ | | ○ | | ○ | | ○ | | ○ | | ○ | | ○ | | ○ | | ○ | | ○ | | ○ | a |
| 2 | × | | × | | × | | × | | × | | × | | × | | × | | × | | × | | × | | × | | × | | × | | b |
| 1 | ¥ | ○ | | ○ | ¥ | ○ | | ○ | | ○ | | ○ | | ○ | | ○ | | ○ | | ○ | | ○ | | ○ | | ○ | | ○ | a |

WOVEN OR KNITTED FABRIC CONTAINING TWO DIFFERENT YARNS AND CLOTHING COMPRISING THE SAME

TECHNICAL FIELD

The present invention relates to a woven or knitted fabric containing two different types of yarns and a clothing containing the fabric. More specifically, the present invention relates to a woven or knitted fabric containing two different types of yarns, wherein the opening area of the fabric increases as it absorbs water to facilitate the air-permeability of the fabric, while the opening area of the fabric decreases as it becomes dry to reduce the air-permeability, and also to a clothing containing the fabric.

The woven or knitted fabric containing two different types of yarns according to the present invention is free from the uncomfortable feeling caused by wetting as well as inferior air-permeability thereof due to sweat when wearing the same.

BACKGROUND ART

There has been a problem in that, when a woven or knitted fabric of synthetic fiber or natural fiber is applied to a clothing wherein sweat may be produced during the use, such as sportswear or underwear, an uncomfortable feeling occurs due to the dampness, and the inferior air-permeability, by caused by the sweat.

An air-permeability self-adjustment type woven or knitted fabric has been proposed, as means for eliminating such a uncomfortable feeling caused by sweating, in which the air-permeability of the woven or knitted fabric increases as the humidity within the clothing becomes higher due to sweating, so that moisture dwelling in the clothing is effectively discharged therefrom, while the air-permeability of the woven or knitted fabric decreases as the humidity within the clothing becomes lower when the sweating stops, so that the chilliness due to the excessive discharge of moisture is restricted, whereby the wearing comfort is always maintained.

For example, in Japanese Unexamined Patent Publication (Kokai) No. 3-213518, a woven or knitted fabric including side-by-side type conjugated fibers is disclosed, in which different kinds of polymer layers, namely a polyester layer and a polyamide layer, are bonded together. The wetness of clothing and the deterioration of the air-permeability are eliminated by the deformation of the fiber when moisture is highly absorbed therein by using the difference in moisture absorption between the different kinds of polymer layers. However, in the side-by-side type conjugated fiber, an amount of deformation in fiber configuration is small even if a large amount of moisture is absorbed, whereby the performance thereof has not been sufficiently exhibited. Further, there is another problem in that special production facilities are necessary for simultaneously spinning the two kinds of polymers, resulting in increase in the production cost.

Also, Japanese Unexamined Patent Publication No. 10-77544 discloses a woven or knitted fabric formed of a moisture-absorbing twisted yarn produced by twisting a yarn of moisture-absorbing polymer fibers. This fabric changes its shape from a planar structure to a three-dimensional structure by generating a twisting torque when absorbing moisture to increase the air-permeability. However, this woven or knitted fabric is problematic in that the fabric dimension is becomes unstable because the fabric largely changes from the planar structure to the three-dimensional structure when absorbing moisture. In addition, as a yarn twisting process is necessary, there is a problem in that the production cost rises.

DISCLOSURE OF THE INVENTION

An object of the present invention is to provide a woven or knitted fabric containing two different types of yarns and clothing containing the same wherein, although the opening area of the fabric increases as it absorbs moisture to facilitate the air-permeability of the fabric and the opening area of the fabric decreases as it becomes dry to reduce the air-permeability, the change in dimension and configuration of the fabric is minimized.

The inventors of the present invention have diligently studied to achieve the above-mentioned object and found that it is possible to minimize the change in dimension of a woven or knitted fabric obtained from a two types of yarns different from each other in self-elongating property upon absorbing water, by providing a specific difference in yarn length in the weave or knit stitch, wherein the change in dimension of the fabric becomes less between the wet state and the dry state, and the opening area of the fabric increases due to the water absorption (moisture absorption) to facilitate the air-permeability, while the opening area of the fabric decreases when dried to lower the air-permeability. Based on such knowledge, the present invention has been completed.

The two-different-yarn-containing woven or knitted fabric of the present invention is a woven or knitted fabric containing two types of yarn different, in self-elongating property upon absorbing water, from each other wherein, when a test piece is prepared from the fabric in such a manner that said woven or knitted fabric is stabilized in dimension in the atmosphere having a temperature at 20° C. and a relative humidity at 65% and then cut into pieces of 30 cm long in the warp or wale direction and 30 cm long in the weft or course direction; and yarns (1) having a high water-absorbing and self-elongating property and yarns (2) having a low water-absorbing and self-elongating property and respectively contained in the test pieces satisfy the following requirement:

$$A/B \leqq 0.9$$

wherein A represents a mean length of the yarns (1) having high water-absorbent and self-elongative property and B represents a mean length of said yarns (2) having low water-absorbing and self-elongating property, the yarns (1) and (2) being arranged in the same direction as each other in the test piece and picked up from the test piece; the length of the respective yarn being measured under a load of 1.76 mN/dtex when the yarn is a non-elastic yarn having an elongation at break of 200% or less or under a load of 0.0088 mN/dtex when the yarn is an elastic yarn having an elongation at break higher than 200%, and whereby the air-permeability of said fabric increases when wetted with water.

In the woven or knitted fabric of the present invention containing two different types of yarn, when the two types of yarns (1) and (2) different in the water-absorbing and self-elongating property are respectively subjected to a measurement of self-elongation upon absorbing water in such a manner that each of the yarns is wound 10 times around a reel for hank having a circumference of 1.125 m long under a load of 0.88 mN/dtex to form a hank; the hank is removed from the reel and left to stand in the air atmosphere having a temperature at 20° C. and a relative humidity at 65% for 24 hours to dry the hank; then the length (Ld, m) of the dry hank is measured under a load of 1.76 mN/dtex when the yarn is a non-elastic yarn having an elongation at break of 200% or less, or under a load of 0.0088 mN/dtex when the yarn is an elastic yarn having an elongation at break higher than 200%; the hank is immersed in water at a temperature at 20° C. for 5 minutes; then the hank is taken out from water; a length (Lw, m) of the wet hank is measured under the same load as described above in response to the elongation at break of the hank; and the self-elongation of each yarn is calculated in accordance with the following equation:

$$\text{Self-elongation of yarn}(\%)=[(LW-Ld)/(Ld)]\times 100,$$

preferably, one (1) of the two type of yarns is a high water-absorbing, self-elongating yarn having a mean self-elongation of +5% or more and the other (2) is a low water-absorbing, self-elongating yarn having a mean self-elongation lower than +5%.

In the woven or knitted fabric of the present invention containing two different types of yarns, preferably the difference ($E_{(1)}-E_{(2)}$) between the self-elongation ($E_{(1)}$) upon absorbing water of the yarn (1) and the self-elongation ($E_{(2)}$) upon absorbing water of the yarn (2) is in a range of from 5 to 40%.

The woven or knitted fabric of the present invention containing two different types of yarns may have a knitted fabric structure, in which the yarns (1) and (2) are combined in parallel with each other, and the combined yarns form composite yarn loops in the fabric.

The woven or knitted fabric of the present invention containing two different types of yarn may have a woven fabric structure in which the yarns (1) and (2) are combined in parallel with each other, and the combined yarns form at least one of the warps and wefts of the woven fabric.

In the woven or knitted fabric of the present invention containing two different types of yarn, composite yarns or paralleled yarns formed from the two different types of yarns (1) and (2), and the yarn (2) is preferably arranged alternately with every at least one yarn in at least one direction selected from the warp and weft directions of the woven fabric structure or in at least one direction selected from the wale and course directions in the knitted fabric structure.

In the woven or knitted fabric of the present invention containing two different types of yarns, preferably at least one yarn (1) is combined with at least one yarn (2) to form a composite yarn.

In the woven or knitted fabric of the present invention containing two different types of yarns, fibers from which the yarn (1) having a high water-absorbing and self-elongating property is constituted, are preferably selected from polyetherester fibers formed from polyetherester elastomer comprising hard segments comprising polybutylene terephthalate blocks and soft segments comprising polyoxyethylene glycol blocks.

In the woven or knitted fabric of the present invention containing two different types of yarn, fibers from which the yarn (2) having a low water-absorbing and self-elongating property is preferably constituted, are selected from polyester fibers.

In the woven or knitted fabric of the present invention containing two different types of yarns, when the fabric is subjected to a measurement of change in yarn gap area of the fabric in such a manner that a plurality of test pieces of the woven or knitted fabric are left to stand in the air atmosphere having a temperature at 20° C. and a relative humidity at 65% for 24 hours to prepare a plurality of dry test pieces, and separately a plurality of another test pieces of said woven or knitted fabric are immersed in water at a temperature at 20° C. for 5 minutes, then taken out from water, and sandwiched between a pair of filter papers under the pressure of 490 N/m$^2$ for one minute to remove water existing in the interstices between fibers in the test pieces to prepare a plurality of wet test pieces, the surfaces of each of the dry and wet test pieces are observed by an optical microscope at a magnification of 20 and the opening areas of the dry and wetted test pieces are measured in accordance with the following equation:

$$\text{Opening area}(\%)=[(\text{total area of openings formed between yarns})/(\text{observed area})]\times 100$$

then, a mean value of the measured opening areas of each of the dry and wetted test piece and a change between the mean opening area of the wetted test pieces and the mean opening area of the dry test pieces was calculated in accordance with the following equation:

$$\text{Change in opening area}(\%)=[(\text{mean opening area of wetted test pieces})-(\text{mean opening area of dry test pieces})]/(\text{mean opening area of dry test pieces})\times 100,$$

the resultant change in the opening area is preferably at least 10%.

In the woven or knitted fabric of the present invention containing two different types of yarn, preferably, when a plurality of test pieces of the woven or knitted fabric are left to stand in the air atmosphere having a temperature of 20° C. and a relative humidity of 65% for 24 hours to prepare a plurality of dry test pieces, and separately a plurality of other test pieces of the woven or knitted fabric are immersed in water at a temperature of 20° C. for 5 minutes, taken out from water, and sandwiched between a pair of filter papers under the pressure of 490 N/m$^2$ for one minute to remove water existing in the interstices between fibers in the test piece to prepare a plurality of wet test pieces, air-permeabilities of the dry and wetted test pieces are measured in accordance with JIS L 1096-1998, 6.27.1, Method A (Frazir type method), and a mean air-permeability of the dry test pieces and a mean air-permeability of the wet test pieces are calculated from the measurement data, and the change in air-permeability is calculated in accordance to the following equation:

$$\text{Change in air-permeability}=[(\text{mean air-permeability of wetted test pieces})-(\text{mean air-permeability of dry test pieces})]/(\text{mean air-permeability of dry test pieces})\times 100,$$

the resultant change in air-permeability is 30% or more.

The woven or knitted fabric of the present invention containing two different types of yarns preferably has a change in roughness of at least 5%; determined in such a manner that a plurality of test pieces of the woven or knitted fabric are left to stand in the air atmosphere at a temperature of 20° C. at a relative humidity of 65% for 24 hours to prepare a plurality of dry test pieces, and separately a plurality of other test pieces of the woven or knitted fabric are immersed in water at a temperature of 20° C. for 5 minutes, are taken out from water, and then are sandwiched between a pair of filter papers under the pressure of 490 N/m$^2$ for one minute to remove water existing in the interstices between fibers in the test pieces to prepare a plurality of wet test pieces, thickness (H1) of convex portions and thickness (H2) of concave potions formed in the woven or knitted fabric structure of each dry and wetted test pieces are measured, a roughness of each of the dry and wetted test pieces is calculated in accordance with the following equation:

Roughness(%)=

(thickness $H1$ of convex portion)−thickness $H2$ of concave portion)/(thickness $H2$ of concave portion)×

100 wherein the thickness H1 of the convex portion is a mean thickness of a convex portion having an area of 1 mm×1 mm and the thickness H2 of the concave portion is a mean thickness of the concave portion located in an approximately center part between two convex portions adjacent to the concave portion in the warp or course direction thereof, and the change in roughness is calculated in accordance with the following equation:

Change in roughness=

[(roughness of wetted test piece)−(roughness of dry test piece)]/100,

The woven or knitted fabric of the present invention containing two different types of yarns may have a woven fabric structure in which structure a group ($W_{(1)}$) consisting of a plurality of warp yarns, each formed solely from the yarns (2) having a low water-absorbing, self-elongating property and a group ($W_{(1+2)}$) consisting of a plurality of warp yarns, each formed of a composite yarn or a paralleled yarn formed from the yarns (1) having a high water-absorbing, self-elongating property and the yarns (2) having a low water-absorbing, self-elongating property, are alternately arranged with each other and the warp yarn groups intersect a group ($F_{(1)}$) consisting of a plurality of weft yarns, each formed solely from the yarns (2) having a low water-absorbing, self-elongating property, and a group ($F_{(1+2)}$) consisting of a plurality of weft yarns, each formed from composite yarns formed from the yarns (1) having a high water-absorbing, self-elongating property and the yarns (2) having a low water-absorbing, self-elongating property, whereby a plurality of regions having a high water-absorbing, self-elongating property and formed by the intersection of the warp group ($W_{(1+2))}$) and the weft group ($F_{(1+2)}$), are arranged with spaces from each other both in the warp and weft directions, in the form of islands in sea.

The woven or knitted fabric of the present invention containing two different types of yarns may have a double knitted structure comprising a cylinder side knitted layer and a dial side knitted layer tucked from either one of said layers to the other, wherein the cylinder side knitted layer is formed from the yarn (2) having a low water-absorbing, self-elongating property, and in the dial side knitted layer, regions composed solely of the yarn (2) having a low water-absorbing, self-elongating property and regions composed of composite yarns, each formed of the yarn (1) having a high water-absorbing, self-elongating property and the said yarn (2) having a low water-absorbing, self-elongating property, are arranged alternately with each other in the course direction and/or the wale direction.

The woven or knitted fabric of the present invention containing two different types of yarns may have a triply knitted structure comprising a cylinder side knitted layer, a dial side knitted layer and an intermediate knitted layer disposed between the above-mentioned two layers; in every adjacent two layers of the three knitted layers, either one of the two layers being touched from the other, wherein the intermediate knitted layer is formed solely of the yarns (2) having a low water-absorbing, self-elongating property, and in each of said dial side and cylinder side knitted layers, regions composed solely of the yarns (2) having a low water-absorbing, self-elongating property and regions composed of composite yarns, each formed of the yarn (1) having a high water-absorbing, self-elongating property and the yarn (2) having a low water-absorbing, self-elongating property, are alternately arranged with each other in the course direction and/or the wale direction.

The woven or knitted fabric of the present invention containing two different types of yarns may have a knitted fabric structure formed from of the two types of yarns (1) and (2), wherein the knitted fabric structure has a yarn density satisfying the following equation:

$$Co \times We \geqq 2{,}000$$

wherein Co represent the number of courses per 2.54 cm in the transverse direction of said knitted fabric, and We represent the number of wales per 2.54 cm in the longitudinal direction of said knitted fabric.

In the woven or knitted fabric of the present invention containing two different yarns, one surface of said woven or knitted fabric may be raised by the raising treatment.

The woven or knitted fabric of the present invention containing two different types of yarns preferably has an air-permeability of 50 ml/cm$^2$.sec or less, determined in accordance with JIS L 1096-1998, 6.27.1, Method A (Frazir type method), in the air atmosphere having a temperature of 20° C. and a relative humidity of 65%.

The woven or knitted fabric of the present invention containing two different types of yarns may have a woven fabric structure in which one of warp and weft of the fabric is formed from composite or paralleled yarns, each formed from at least one yarn having a high water-absorbing, self-elongating property and at least one yarn having a low water-absorbing, self-elongating property, and the other one of warp and weft is formed from the yarns having a low water-absorbing, self-elongating property, and further exhibiting a cover factor in a range of from 1,800 to 2,800.

In the woven or knitted fabric of the present invention containing two different types of yarns, the said composite yarn preferably comprises a core portion formed from at least one yarn having a high water-absorbing, self-elongating property and a sheath portion surrounding around the core portion and formed from a plurality of yarns having a low water-absorbing, self-elongating property.

The clothing of the present invention comprises the woven or knitted fabric containing two different types of yarns as mentioned above, and capable of increasing the air-permeability thereof upon absorbing water.

In the clothing of the present invention, at least one portion of said clothing, selected from an armhole, a side, a bust, a back and a shoulder, is preferably formed from the woven or knitted fabric containing two different yarns.

The clothing of the present invention may be selected from underwear.

The clothing of the present invention may be selected from sportswear.

BRIEF DESCRIPTION OF THE DRAWINGS

FIG. 8 illustrate a knitting structure of a knitted fabric having a two ply knitting structure, as an embodiment of the woven or knitted fabric of the present invention comprising two different types of yarns as shown in FIG. 5;

BEST MODE FOR CARRYING OUT THE INVENTION

Figure 1:
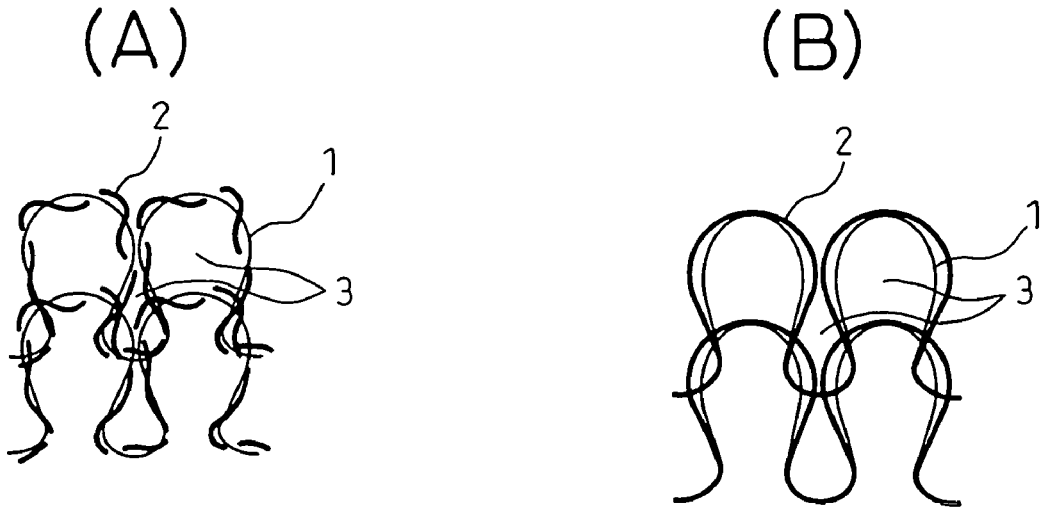
In FIG. 1, FIG. 1-(A) shows an explanatory plane view of a circular knitting structure (loop structure) in dry state, formed from paralleled yarns constituted from two types of yarns different from each other, as an embodiment of the woven or knitted fabric containing two different types of yarns of the present invention, and FIG. 1-(B) shows an explanatory plane view of the circular knitting structure formed from the paralleled yarns as shown in FIG. 1-(A), upon wetting with water.

The woven or knitted fabric of the present invention containing two different types of yarns is a fabric containing two types of yarns different from each other in self-elongating property upon absorbing water.

When the woven or knitted fabric is stabilized in dimension in the air atmosphere having a temperature at 20° C. and a relative humidity at 65%, and then cut into test pieces of 30 cm long in the warp or wale direction and 30 cm long in the weft or course direction, the yarns (1) having a high water-absorbing and self-elongating property and yarns (2) having a low water-absorbing and self-elongating property contained in the fabric pieces satisfy the following equation:

$$A/B \leq 0.9$$

wherein A represents a mean length of the yarns (1) having high water-absorbent and self-elongative property and B represents a mean length of said yarns (2) having low water-absorbing and self-elongating property, the yarns (1) and (2) being arranged in the same direction as each other in the test piece and picked up from the test piece; the length of the respective yarn being measured under a load of 1.76 mN/dtex when the yarn is a non-elastic yarn having an elongation at break of 200% or less or under a load of 0.0088 mN/dtex when the yarn is an elastic yarn having an elongation at break higher than 200%, and whereby the resultant woven or knitted fabric exhibits such a specific performance that when the woven or knitted fabric is wetted with water and absorbs water, the opening area of the fabric increases and thus the air permeability of the fabric increases and when the fabric is dried, the opening area of the fabric decreases and thus the air permeability of the fabric decreases. The number (n) of the test pieces of yarns for the measurement of the mean length of the yarns is preferably 5 to 20.

In the woven or knitted fabric of the present invention, the ratio A/B in the mean length of the yarn (1) having a high water-absorbing and self-elongating property to that of the yarn (2) having a low water-absorbing and self-elongating property is 0.9 or less as described above, preferably in a range from 0.2 to 0.9 as mentioned above, more preferably from 0.3 to 0.8. If the ratio A/B exceeds 0.9, the change in air-permeability of the woven or knitted fabric between the dry state and the wet state becomes insufficient.

The high water-absorbing and self-elongating yarns may be formed from either elastic fibers or non-elastic fibers preferably if they exhibit elastic stretchability and shrinkability. The elastic yarn constituted from the elastic fibers preferably has an elongation at break higher than 200%. On the other hand, while there is no limitation in the elongation at break of the yarn formed from the non-elastic fibers, it is preferably 200% or less.

In the woven or knitted fabric of the present invention containing two different types of yarns, the yarns (1) and (2) different in the water-absorbing and self-elongating property from each other preferably satisfy the following condition:

When the two types of yarns (1) and (2) different in the water-absorbing, self-elongating property are respectively subjected to a measurement of self-elongation upon absorbing water in such a manner that each of the yarns is wound 10 times around a reel for hank having a circumference of 1.125 m long under a load of 0.88 mN/dtex to form a hank; the hank is removed from the reel and left to stand in the air atmosphere having a temperature at 20° C. and a relative humidity at 65% for 24 hours to dry the hank; then the length (Ld, m) of the dry hank is measured under a load of 1.76 mN/dtex when the yarn is a non-elastic yarn having an elongation at break of 200% or less, or under a load of 0.0088 mN/dtex when the yarn is an elastic yarn having an elongation at break higher than 200%; the hank is immersed in water at a temperature at 20° C. for 5 minutes; then the hank is taken out from water; a length (Lw, m) of the wet hank is measured under the same load as described above in response to the elongation at break of the hank; and the self-elongation of each yarn is calculated in accordance with the following equation:

$$\text{Self-elongation of yarn}(\%)=[(LW-Ld)/(Ld)]\times 100,$$

preferably one (1) of the two type of yarns is a high water-absorbing and self-elongating yarn having a mean self-elongation of +5% or more and the other (2) is a low water-absorbing and self-elongating yarn having a mean self-elongation lower than +5%. More preferably, the mean self-elongation of the yarn (1) is +6% or more, and the mean self-elongation of the yarn (2) is +4% or less. Still more preferably, the yarns (1) and (2) have a mean self-elongations of +8 to +30% and 0 to +3%, respectively. The number (n) of the test pieces for the above-mentioned measurement is preferably 5 to 20.

The difference ($E_{(1)}-E_{(2)}$) between the self-elongation ($E_{(1)}$) upon absorbing water of the yarn (1) and the self-elongation ($E_{(2)}$) upon absorbing water of the yarn (2) is preferably in a range of from 5 to 40%, more preferably 7 to 30%, still more preferably 10 to 30%. If the self-elongation difference ($E_{(1)}-E_{(2)}$) is less than 5%, the difference in the opening area of the woven or knitted fabric containing two different types of yarns between a dry condition and a wetted condition may become insufficient and thereby cause the air-permeability of the fabric upon absorbing water and being wetted with water to be insufficient. Contrarily, if the difference exceeds 40%, the air-permeability may become excessively high in the wetted state with water or excessively small in the dry state.

In the woven or knitted fabric of the present invention, a ratio in mass of the yarn (1) having a high water-absorbing and self-elongating property to the yarn (2) having a low water-absorbing and self-elongating property is preferably, in the woven fabric, in a range from 10:90 to 70:30, more preferably from 15:85 to 50:50, while preferably, in the knitted fabric, in a range from 10:90 to 60:40, more preferably from 20:80 to 50:50.

In one embodiment of the woven or knitted fabric of the present invention containing two different types of yarns, the fabric is in a knitted fabric structure, for example, a circular knitting structure wherein the two types of yarns (1) and (2) are combined with each other and used as paralleled yarns.

As shown in FIG. 1 (FIGS. 1-(A) and 1-(B), the two types of yarns (1) and (2) are paralleled to each other in a dry state. In this case, the yarn (1)1 having a high water-absorbing and self-elongating property is mechanically stretched (drafted) and then paralleled to the yarn (2)2 having a low water-absorbing and self-elongating property to form a paralleled yarn, and the resultant paralleled yarn is subjected to the knitting process. After the knitting process, when a tension applied to the dry yarn (1)1 is released, the yarn (1)1 shrinks. However, the yarn (2)2 having a low water-absorbing and self-elongating property substantially does not shrink. In the resultant knitted fabric structure, as a ratio A/B of the mean length A of the yarn (1)1 to the mean length B of the yarn (2)2 is controlled to 0.9 or less, the longer yarn (2)2 is entangled around the yarn (1)1 and, thereby, an apparent thickness of the paralleled yarn increases. A ratio in area of openings 3 to a total surface area of the knitted fabric; that is, a opening area (percentage); is relatively low at that time. If the dry knitted fabric shown in FIG. 1-(A) absorbs water to be in a wetted state, the yarn (1)1 absorbs water and elongates itself as shown in FIG. 1-(B). Accompanied therewith, the yarn (2)2 becomes generally in a tensed state, and whereby the apparent thickness of the paralleled yarn becomes smaller and the gap area percentage of the wetted fabric shown in FIG. 1-(B) becomes larger than that of the dry fabric shown in FIG. 1-(A) to facilitate the air-permeability.

Figure 2:
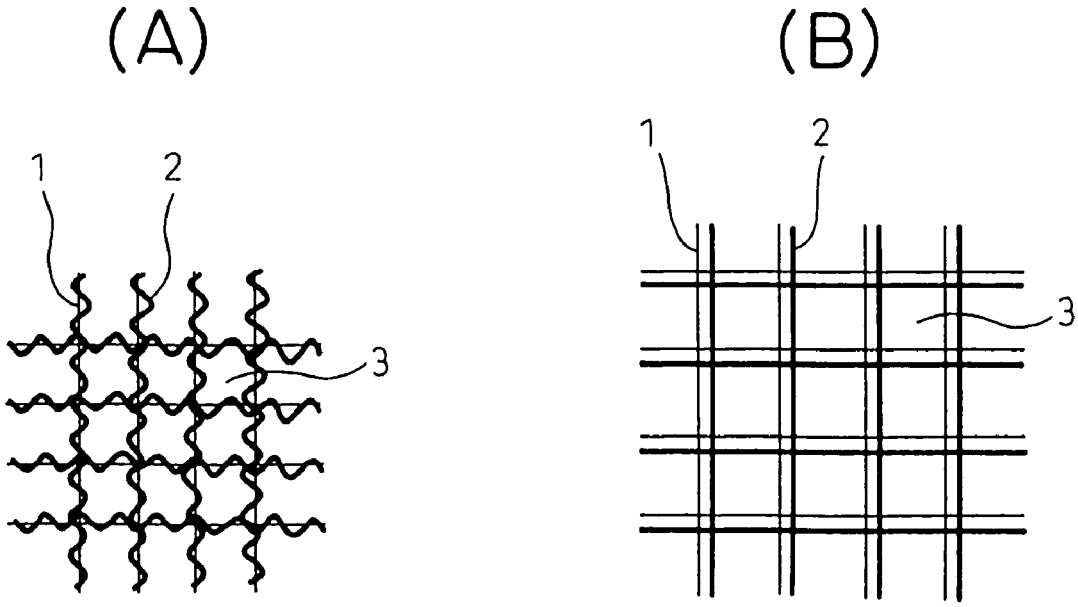
In FIG. 2, FIG. 2-(A) shows an explanatory plane view of a plain weave structure in dry state, formed from paralleled yarns constituted from two types of yarns different from each other, as another embodiment of the woven or knitted fabric containing two different types of yarns of the present invention, and FIG. 2-(B) shows an explanatory plane view of the plain weave structure formed from the paralleled yarns as shown in FIG. 2-(A) upon wetting with water.

In another embodiment of the woven or knitted fabric of the present invention containing two different types of yarns, the fabric has a woven fabric structure, for example a plain weave structure wherein warp and weft yarns are respectively constituted by paralleled yarns constituted from the yarn (1)1 having a high water-absorbing and self-elongating property and the yarn (2)2 having a low water-absorbing and self-elongating property. If such paralleled yarns are used as warp and weft to form a woven fabric, the yarn (1)1 having a high water-absorbing and self-elongating property is paralleled in a dry state while being mechanically stretched under, a tension in a dry state, with the yarn (2)2 and the resultant paralleled yarn is subjected to the weaving procedure. After completing the weaving procedure, the tension is released and thus the yarn (1)1 mechanically shrinks, while the yarn (2)2 substantially does not shrink. Since the ratio A/B of the mean length A of the yarn (1)1 to the mean length of the yarn (2)2 is controlled to be 0.9 or less in the resultant woven structure, the longer yarn (2)2 is crimped around the shorter yarn (1)1 as shown in FIG. 2A, whereby an apparent thickness of the paralleled yarn increases. As a result, the opening area of the resultant woven fabric is relatively low in a dry state. When the woven fabric absorbs water to a wetted state, the yarn (1)1 absorbs water and elongates itself as shown in FIG. 2B, while the yarn (2)2 is in a tensed state while being accompanied therewith, and whereby the opening area of the wetted fabric becomes higher than the opening area of the dry fabric to facilitate the air-permeability. Methods for weaving and knitting the fabrics shown in FIGS. 1 and 2 by using the paralleled yarns constituted from the yarns (1) and (2) will be further described hereinafter.

In the woven or knitted fabric of the present invention containing two different types of yarns, the change in the yarn gap area of the fabric between the dry state and the wet state is obtained by the following measurement.

A woven or knitted fabric to be tested is subjected to a measurement of change in opening area of the fabric in such a manner that a plurality of test pieces of the woven or knitted fabric are left to stand in the air atmosphere having a temperature at 20° C. and a relative humidity at 65% for 24 hours to prepare a plurality of dry test pieces and, separately, a plurality of other test pieces of said woven or knitted fabric are immersed in water at a temperature at 20° C. for 5 minutes, then taken out from water, and sandwiched between a pair of filter papers under the pressure of 490 N/m$^2$ for one minute to remove water existing in the interstices between fibers in the test pieces to prepare a plurality of wet test pieces, surfaces of each of the dry and wet test pieces are observed by an optical microscope at a magnification of 20 and the yarn gap areas of the dry and wetted test pieces are measured in accordance with the following equation:

opening area(%)=[(total area of openings between yarns)/(observed area)]×100 then, a mean value of the measured opening areas of each of the dry and wetted test piece and a change in mean opening area between the wetted test pieces and the dry test pieces was calculated in accordance with the following equation:

Change in opening area(%)=

[(mean opening area of wetted test pieces)−

(mean opening area of dry test pieces)]/(mean opening area of dry test pieces)×100.

The number n of the test pieces for the above-mentioned measurement is preferably 5 to 20.

The change in opening area of the woven or knitted fabric of the present invention containing the two different types of yarns between the dry state and the wetted state is preferably at least 10%, more preferably 20% or more, still more preferably 50 to 200%. If the change in opening area is less than 10%, there might be a case wherein the air-permeability of the fabric in the wet state is insufficient.

The mean air-permeability of the woven or knitted fabric of the present invention containing two different types of yarns and the change in air-permeability of the fabric between the dry and wet states can be measured in the following manner.

Test pieces of the woven or knitted fabric are left to stand in the air atmosphere having a temperature of 20° C. and a relative humidity of 65% for 24 hours to prepare a plurality of dry test pieces and, separately, a plurality of other test pieces of the woven or knitted fabric are immersed in water at a temperature of 20° C. for 5 minutes, taken out from water, and sandwiched between a pair of filter papers under the pressure of 490 N/m$^2$ for one minute to remove water existing in the interstices between fibers in the test piece to prepare a plurality of wet test pieces, air-permeabilities of the dry and wetted test pieces are measured in accordance with JIS L 1096-1998, 6.27.1, Method A (Frazir type method), and a mean air-permeability of the dry test pieces and a mean air-permeability of the wet test pieces are calculated from the measurement data, and the change in air-permeability is calculated in accordance to the following equation:

Change in air-permeability=

[(mean air-permeability of wetted test pieces)−

(mean air-permeability of dry test pieces)]/(mean air-permeability of dry test pieces)×100.

In the woven or knitted fabric of the present invention containing two different types of yarns, the change in air-permeability is preferably 30% or more, more preferably 40% or more, further more preferably in a range from 50 to 300%. The number n of test pieces is preferably in a range from 5 to 20.

The air-permeability of the woven or knitted fabric of the present invention containing two different types of yarns is preferably 50 ml/cm$^2$.sec or less, more preferably 5 to 48 ml/cm$^2$.sec, measured in a dry state, particularly in an atmosphere having a temperature at 20° C. and a relative humidity at 65%, in accordance with JIS L 1096-1998, 6.27.1, Method A (Frazir type method). The dry fabric having the above-mentioned air-permeability can exhibit a practically sufficient wind-shielding property.

In the woven or knitted fabric of the present invention containing two different types of yarns, fibers usable for the yarn (1) having a high water-absorbing and self-elongating property are preferably selected from, for example, polyether-ester fibers formed from polyether ester elastomer containing hard segments comprising polybutylene terephthalate blocks and soft segments comprising polyoxyethylene glycol blocks, but are not necessarily limited thereto.

The other fibers for the yarn (1) are, for example, polyester fibers consisting of a polyester composition comprising a polyester polymer blended with a polyacrylate metal salt, polyacrylic acid or a copolymer thereof, polymethacrylate or a copolymer thereof, polyvinyl alcohol or a copolymer thereof, polyacrylamide or a copolymer thereof, polyoxyethylene polymer or another, or polyester fibers containing copolymerized 5-sulfoisophthalate. Among them, the polyether ester fibers, which are formed from a polyether ester elastomer comprising hard segments formed from polybutylene terephthalate blocks and soft segments formed from polyoxyethylene glycol blocks, are preferably used.

The polybutylene terephthalate used for the hard segments preferably contains butylene terephthalate units of 70 mol % or more. The content of the butylene terephthalate segments is preferably 80 mol % or more, more preferably 90 mol % or more. An acid component for the polymer for constituting the hard segments contains mainly terephthalic acid which may be copolymerized with a small amount of other dicarboxylic acid component, and the glycol component mainly comprises tetramethylene glycol which may be copolymerized with other glycol component.

The dicarboxylic acid component other than terephthalic acid used for forming the polymer for the hard segments is selected from, for example, aromatic or aliphatic dicarboxylic acid components such as naphthalene dicarboxylic acid, isophthalic acid, diphenyl dicarboxylic acid, diphenylxyethane dicarboxylic acid, β-hydroxyethoxy benzoic acid, p-oxybenzoic acid, adipic acid, sebacic acid, 1,4-cyclohexane dicarboxylic acid. Further, trifunctional polycarboxylic acid or more such as trimellitic acid or pyromellitic acid may be used as a copolymer component within a range wherein the achievement of the object of the present invention is not disturbed.

The diol component other than tetramethylene glycol used for forming the polymer for the hard segments is selected from, for example, aliphatic, alicyclic or aromatic diol compounds such as trimethylene glycol, ethylene glycol, cyclohexane-1,4-dimethanol or neopentyl glycol. Also, tri- or more-functional polyol such as glycerin, trimethyrol propane or pentaerythritol may be used as a copolymer component within a range wherein the achievement of the object of the present invention is not disturbed.

Also, polyoxyethylene glycol for forming the soft segments preferably contains oxyethylene glycol units in a content of 70 mol % or more. The content of oxyethylene glycol is more preferably 80 mol % or more, further more preferably 90 mol % or more. Propylene glycol, tetramethylene glycol or glycerin may be copolymerized in addition to the oxyethylene glycol, within a range wherein the achievement of the object of the present invention is not disturbed.

The number-average molecular weight of polyoxyethylene glycol for the soft segment is preferably in a range from 400 to 8,000, more preferably from 1,000 to 6,000.

The above-mentioned polyether-ester elastomer can be produced, for example, by a transesterification reaction of dimethyl phthalate with a material containing tetramethylene glycol and polyoxyethylene glycol in the presence of a transesterification catalyst to prepare bis(ω-hydroxybutyl) terephthalate monomer and/or oligomer, and then the monomer and/or oligomer is subjected to a melt-polycondensation reaction in the presence of a polycondensation catalyst and a stabilizer at a high temperature and under a reduced pressure.

A ratio by mass of the hard segments to the soft segments in the polyether-ester elastomer as mentioned above is preferably in a range from 30/70 to 70/30.

When a metal salt of an organic sulfonic acid is copolymerized with polyetherester polymer for the yarn (1), the water-absorbing and self-elongating property of the elastomer is further enhanced.

The polyether-ester fiber for the yarn (1) is produced by melting and extruding the above-mentioned polyetherester in and through a conventional melt-spinning spinneret, then is taken up at a take-up speed in a range from 300 to 1200 m/min (preferably from 400 to 980 m/min) and wound at a draft of 1.0 to 1.2 times (preferably 1.0 to 1.1 times) the take-up speed.

Fibers constituting the yarn (2) having a low water-absorbing and self-elongating property used for the woven or knitted fabric of the present invention containing two different types of yarns include natural fibers such as cotton or hemp fibers, cellulose chemical fibers such as rayon or cellulose acetate fibers, and synthetic fibers such as polyester fibers, typically polyethylene terephthalate and polytrimethylene terephthalate fiber, polyamide polyacrylonitrile and polypropylene fibers. Among them, conventional (non-elastic) polyester fibers are preferably used.

The fibers, from which the yarns (1) and (2) used for the woven or knitted fabric of the present invention are constituted, optionally contain one or more types of inorganic particles, for example, a delusterant (titanium dioxide), a microvoid forming agent (a metal salt of an organic sulfonic acid), a coloration-preventing agent, a heat stabilizer, a flame retardant (diantimony trioxide), a fluorescent brightener, a coloring pigment, an anti-static agent (metal salts of sulfonic acids), a hygroscopic agent (polyoxyalkylene glycol), an anti-fungus agent and others.

There is no limitation to a type of the fibers from which the yarn (1) and (2) are constituted; that is, the fibers may be either multifilaments or staple fibers. However, for the purpose of obtaining a soft touch, the multifilaments are preferably employed.

There is no limitation to the form of the yarn (1) and (2); that is, the yarns may be either spun yarns of staple fibers or multifilament yarns. Also, there is no limitation to a cross-sectional profile of the fibers; that is, the profile may be any of conventional profiles including a circular, a triangular, a flat, a cross-shaped, a hexalobal and a hollow profile. Also, there is no limitation to total yarn thickness, individual fiber thickness, and the number of filaments, the total yarn thickness is preferably in a range from 30 to 300 dtex, the individual fiber thickness is preferably in a range from 0.1 to 10 dtex, more preferably from 0.6 to 3 dtex, and the number of filaments is preferably in a range from 1 to 300, more preferably from 20 to 150 per yarn, in view of the hand and/or the productivity of the fabric.

The ratio by mass of the yarn (1) to the yarn (2), from which the woven or knitted fabric of the present invention is constituted, is preferably in a range from 10:90 to 60:40, more preferably from 20:80 to 50:50, for the purpose of effectively improving the yarn gap area percentage in a wetted state which purpose is a main object of the present invention.

There is no limitation to the structure of the woven or knitted fabric of the present invention of which the air-permeability is not facilitated even in the wetted state. For example, the weave structure for the woven fabric includes three basic weave structures, that is, plain, twill weave and satin weave structures modifications thereof for example, modified twill weave structures, warp or weft two-ply weaves such as warp backed two-ply weave and weft backed two-ply weave structures, and a warp velvet. The knitting structure of the knitted fabric may be either a weft knitting or warp knitting structure. Preferably, the weft knitting structures preferably include plain, rib stitch, interlock, garter, tuck, float, half cardigan, lace and plated knitting structures, and the warp knitting structures preferably include single tricot, single atlas, double cord, half tricot, fleecy, jacquard-knitting structures, etc.

In another embodiment of the woven or knitted fabric of the present invention containing two different types of yarns, the composite yarns or paralleled yarns consisting of the two types of yarns (1) and (2) and the yarns (2) are alternately arranged with every one yarn in the weave structure at least one of the weft and warp directions or in the knitting structure at least one direction selected from wale and course directions, respectively. A ratio in the number of yarns of the composite yarn or the paralleled yarns of the yarns (1) and (2) to that of the yarn (2) in each yarn direction may be 1:1, or 1:(1 to 5), or 2:1, or 2:(2 to 5), or 3:1, or 3:(2 to 5), or 3:(4 or 5) or 3:(1 to 5).

Figure 3:
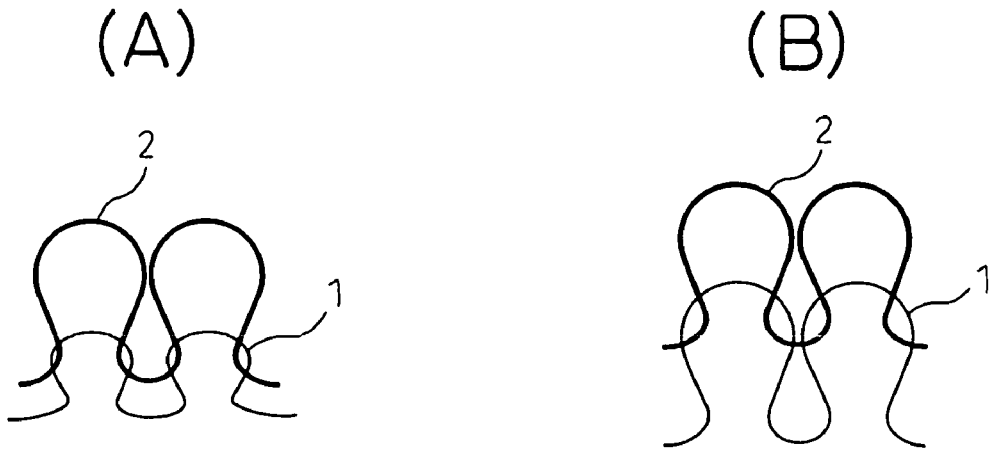
In FIG. 3, FIG. 3-(A) shows an explanatory plane view of a circular knitting structure (loop structure) in dry state, formed from two types of yarns different from each other, arranged alternately with each other, as another embodiment of the woven or knitted fabric containing two different types of yarns of the present invention, and FIG. 3-(B) shows an explanatory plane view of the circular knitting structure as shown in FIG. 3-(A) upon wetting with water.

In the knitting structure shown in FIG. 3, (FIG. 3-(A) and FIG. 3-(B)) the yarn (1)1 having a high water-absorbing and self-elongating property and the yarn (2)2 having a low water-absorbing and self-elongating property are alternately arranged with every one yarn in the wale direction in the dry state to form a knitting structure as shown in FIG. 3-(A). When this fabric is wetted by absorbing water, the yarn (1)1 absorbs water and elongates to form a knitting structure as shown FIG. 3-(B), whereby the opening area of the wetted fabric increases more than that of the dry fabric and thus the air-permeability thereof increases.

Figure 4:
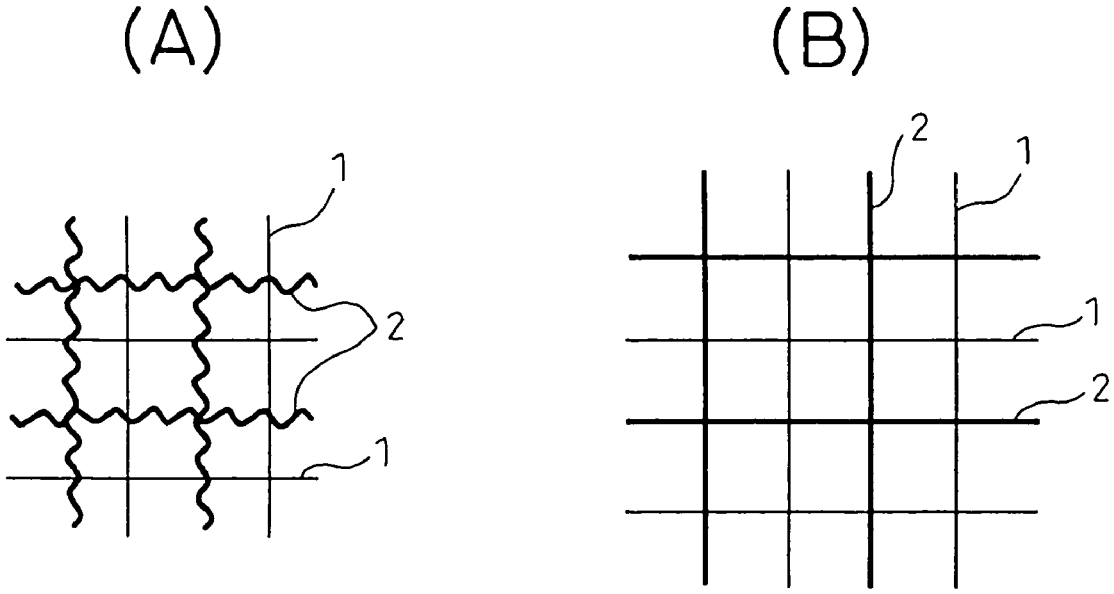
In FIG. 4, FIG. 4-(A) shows an explanatory plane view of a plain weave structure in dry state, formed from two different types of yarns used as warp and weft yarns, as another embodiment of the woven or knitted fabric containing two different types of yarns of the present invention, and FIG. 4-(B) shows an explanatory plane view of the plain weave structure as shown in FIG. 1-(A) upon wetting with water.

A further embodiment of the woven or knitted fabric containing two different types of yarns as shown in FIG. 4 (FIG. 4-(A) and FIG. 4-(B)) has a weave structure wherein the yarn (1)1 and the yarn (2)2 are alternately arranged with every one yarn both in the warp and weft directions. During the weaving procedure, the yarn (1)1 is stretched to be longer than the yarn (2)2 under tension applied to the warp and weft yarns in a dry state. When the tension is released after the completion of the weaving process, the yarn (1)1 shrinks more than the yarn (1)2 whereby a length of the yarn (2)2 becomes longer than that of the yarn (1)1 in the fabric. That is, as shown in FIG. 4-(A), the yarn (2)2 is compressed to be crimped, and to increase an apparent thickness of the yarn (2), whereby the opening area of the fabric becomes relatively small. When this dry fabric is wetted with water, the yarn (1)1 absorbs water and elongates, and the yarn (2) becomes in a generally tense state to increase the opening area percentage and facilitate the air-permeability thereof.

In the woven or knitted fabric of the present invention containing two different types of yarns, the yarn (1) having a high water-absorbing and self-elongating property and the yarn (2) having a low water-absorbing and self-elongating property may be combined to form a composite yarn such as a combined filament yarn, a composite false twist-textured yarn, a combined and twisted yarn or a covering yarn.

To create the difference in yarn length between the yarns (1) and (2) in the woven fabric as shown in, for example, FIG. 1 and FIG. 2, the following weaving methods (1), (2) and (3) are used.

Weaving or Knitting Method (1) for Fabric Having a Difference in Yarn Length

The polyetherester fibers having a high stretch modulus of elongation as mentioned hereinbefore are used for the yarns (1), the yarns (1) are doubled with the yarns (2) while being drafted (stretched) to form a paralleled yarn, the resultant paralleled yarns are then fed to a yarn feeder for the weaving or knitting procedure. At that time, a draft ratio of the polyetherester fiber yarn (1) is preferably 10% or more, more preferably in a range from 20 to 300%. The draft ratio of the high stretch modulus yarn is calculated in accordance with the following equation:

$$\text{Draft ratio}(\%)=[(\text{yarn take-up speed}-\text{yarn feeding speed})]/(\text{yarn feeding speed})\times 100$$

As the polyetherester fibers have a high stretch modulus, the polyetherester fibers (1) are elastically stretched under a tension applied thereto, and when the tension is released after the weaving or knitting procedure, the yarns (1) elastically shrinks to reduce its length. When other yarns (2) are used together with the yarns (1) in the weaving or knitting procedure, in the resultant fabric, a difference in yarn length is created between the yarns (1) and (2).

Weaving or Knitting Method (2) for a Fabric Having a Difference in Yarn Length

When a woven or knitted fabric containing two different types of yarns is woven or knitted from the yarns (1) and (2), for the yarns (1), yarns having a higher boiling water shrinkage than that of the yarns (2) are employed. When the fabric containing these yarns (1) and (2) is subjected to the conventional dyeing process, the yarn (2) more largely shrinks than the yarn (1) and a fabric having a difference in yarn length between the yarns (1) and (2) is obtained.

Weaving or Knitting Method (3) for a Fabric Having a Difference in Yarn Length

When the yarns (1) and (2) are combined with each other to form paralleled yarns, the yarns (2) are overfed and paralleled to the yarns (1). The resultant paralleled yarns are subjected to an air filament-combining procedure, a twisting procedure or a covering procedure to provide composite yarns. In the resultant composite yarns, there is a difference in yarn length between the yarns (1) and (2); that is, the yarns (2) are longer than the yarns (1). A desired fabric is woven or knitted from the paralleled yarns.

Figure 5:
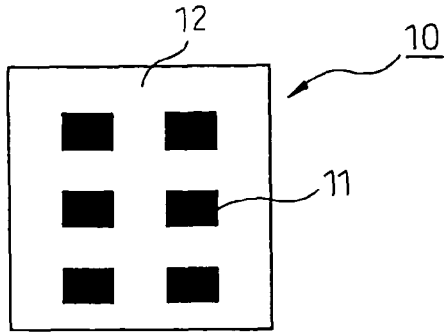
FIG. 5 shows an explanatory plane view of a woven or knitted fabric structure in which a plurality of regions having a largest increase in opening area upon wetting with water are located in the form of a plurality of islands arranged away from each other in a sea, as another embodiment of the woven or knitted fabric of the present invention comprising two different types of yarns.

As shown in FIG. 5, in the woven or knitted fabric 10 of the present invention containing two different types of yarns, a plurality of portions 11 having a high content of the yarn (1) elongating itself upon absorbing water may be distributed separately from each other in a continuous portion 12 having a low content of the yarn (1) in the form of islands-in-sea. Clothing made of such a fabric facilitates the air-permeability mainly in the portions 11 when wetted with water, and creates an irregularity on a surface of the clothing, next to the skin, to reduce a contact area with the skin, whereby the discomfort due to sweating is minimized.

The woven or knitted fabric in which the portions 11 having a high content of the yarn (1) are distributed in an islands in sea form as described above may have either a single ply structure or a two or more ply structure.

Figure 6:
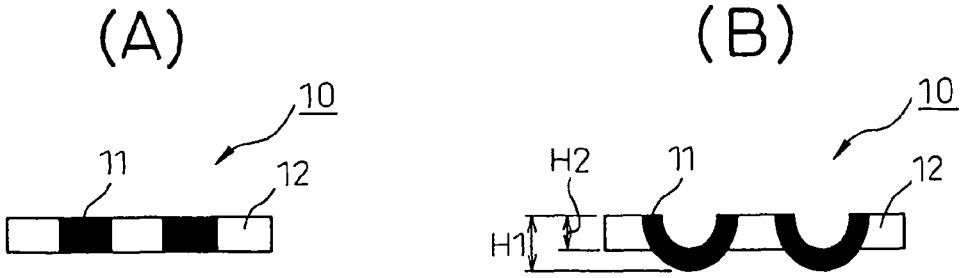
In FIG. 6, FIG. 6-(A) shows an explanatory cross-sectional view of a woven or knitted fabric having a single ply structure in dry state, as an embodiment of weave or knit structure of the woven or knitted fabric of the present invention containing two different types of yarns, and FIG. 6-(B) shows an explanatory cross-sectional view of the woven or knitted structure as shown in FIG. 6-(A), upon being wetted with water.

A woven or knitted fabric 10 shown in FIG. 6 (FIGS. 6-(A) and 6-(B) has a single ply structure wherein regions 11 having a high content of the yarns (1) having a high water-absorbing and self-elongating property are distributed in a region 12 having a low content of the yarns (1) in the form of islands in a sea. When this fabric is wetted by absorbing with water, the yarns (1) in the regions 11 elongate itself due to water-absorption, whereby the regions 11 increase in the area (or the volume) thereof more than that of the region 12 encircling the regions 11 and bulge outside from either surface side of the fabric to form convexities. Thereby, if a clothing made of the fabric shown in FIG. 6-(A) is wetted with water, a plurality of convexities are formed on one surface of the clothing (to be in contact with a skin) to reduce the contact area of the back surface of the clothing with the skin to minimize the discomfort caused by wetting with sweat.

Figure 7:
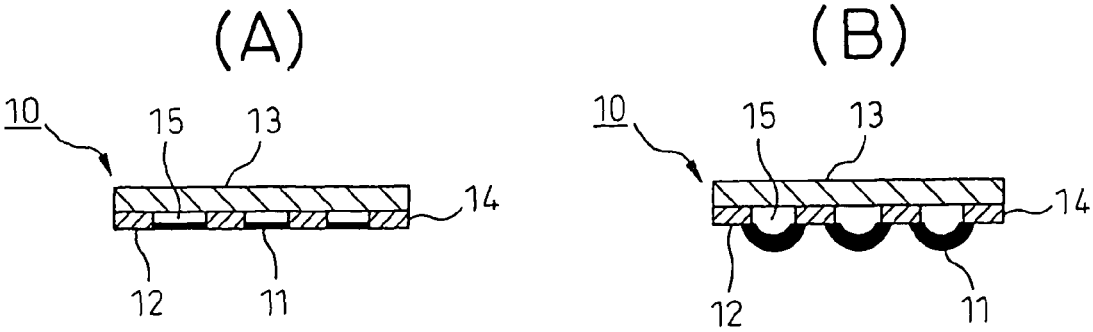
In FIG. 7, FIG. 7-(A) shows an explanatory cross-sectional view of a woven or knitted fabric having a two ply structure in dry state, as an embodiment of the weave and knit structure of the woven or knitted fabric of the present invention containing two different types of yarns, and FIG. 7-(B) shows an explanatory cross-sectional view of the woven or knitted fabric as shown in FIG. 7-(A), upon being wetted with water.

A cross-section of a woven or knitted fabric of the present invention containing two types of yarns having a two ply structure is shown in FIG. 7 (FIGS. 7-(A) and 7-(B)). This fabric 10 has a front surface ply 13 constituted from appropriate yarns and a back surface ply 14 constituted from the woven or knitted fabric of the present invention containing two types of yarns. In the back surface ply 14, a plurality of regions 11 having a high content of the yarn (1) having a high water-absorbing and self-elongating property are distributed in a region 12 having a low content of the yarn (1) in the form of islands in a sea. In the fabric structure as shown in FIG. 7, the regions 11 having a high content of the yarn (1) are formed on the lower side of the back surface ply, and in the regions 11, the front surface ply 13 is not tucked with the back surface ply 14. The spaces 15 shown in FIGS. 7-(A) and 7-(B) indicate that the regions 11 in the back surface ply 14 are not tucked with the front surface ply 13. When this fabric of the two ply structure is wetted with water, the yarns (1) in the regions 11 absorb water and elongate, whereby the regions 11 bulge outside from the lower surface of the back surface ply 14 to form a plurality of convexities on the back surface side of the fabric 10. While the operation and effect of the convexities are the same as those in the fabric shown in FIG. 6, as the regions 11 on the back surface ply 14 are not tucked with the front surface ply 13 in the fabric shown in FIG. 7, the regions 11 of the back surface ply of the fabric are bulge out.

While there is no limitation to the dimensions of each region 11, the dimensions are preferably (3 to 15 mm)×(3 to 15 mm). A gap between the adjacent regions 11 is preferably in a range from 2 to 15 mm both in the warp (or wale) direction and the weft (or course) direction.

The fabric having the regions 11 having a high content of the yarn (2) and capable of elongating in the wet state is suitable for sportswear or underwear which comes into contact with sweat when worn.

Thickness of the concave portions and convex portions formed in the weave or knit structure of the woven or knitted fabric of the present invention, the roughness of the fabric and the change in roughness due to water absorption and wetting can be measured in the following manner.

A plurality of dry test pieces are prepared by leaving the woven or knitted fabric to be tested in air atmosphere having a temperature at 20° C. and a relative humidity of 65% for 24 hours. Also, a plurality of wet test pieces are prepared by dipping the same type of the fabric in a water having a temperature at 20° C. for 5 minutes, then sandwiching it between a pair of filter papers, after being taken out from water, to remove water existing in the interstices between fibers under the application of a pressure of 490 N/m$^2$ for 1 minute. Thicknesses of convexities and concavities formed in the woven or knitted structure of the dry and wet test pieces are measured, for example, by using a super high accuracy laser displacement meter (provided by Keyence (phonetic) Co.; Model LC-2400). Based thereon, the roughness is calculated in accordance with the following equation:

$$\text{Roughness}(\%)=[(\text{thickness } H1 \text{ of convexities})-(\text{thickness } H2 \text{ of concavities})]/(\text{thickness } H2 \text{ of concavities})\times 100$$

wherein H1 is a mean value of a thickness of convexities having an area of 1 mm×1 mm, and H2 is a mean value of a thickness of concavities having an area of 1 mm×1 mm and located between the adjacent two convexities in the warp or course direction.

Further the change in roughness is obtained in accordance with the following equation:

$$\text{Change in roughness}=[(\text{roughness of wet test piece})-(\text{roughness of dry test piece})]\times 100$$

The change in roughness is preferably at least 5%. The number n of the measured test pieces is preferably in a range of from 5 to 20.

In the woven or knitted fabric of the present invention containing two different types of yarns, particularly, in the fabric having the island like regions having a high content of the yarns (1) having a high water-absorbing and self-elongating property and capable of forming convexities upon absorbing water as shown in FIGS. 5 to 7, the change in roughness is preferably 5% or more, more preferably 7% or more, further preferably in the range of from 7 to 100%.

Embodiments of the woven or knitted fabric of the present invention containing two different types of yarns having the regions having a high content of the yarns (1) will be described hereinafter.

In one embodiment (1), the woven or knitted fabric of the present invention containing two different types of yarns containing two different types of yarns has a woven fabric structure, wherein a plurality of warp yarn group ($W_{(2)}$) consisting solely of the yarns (2) having a low water-absorbing and self-elongating property and a plurality of warp yarn group ($W_{(1+2)}$) consisting of composite or paralleled yarns formed from the yarn (1) having a high water-absorbing and self-elongating property and the yarns (2) having a low water-absorbing and self-elongating property are alternately arranged with each other and intersect with a plurality of weft yarn group ($F_{(2)}$) consisting solely of the yarns (2) having a low water-absorbing and self-elongating property and a plurality of weft yarn group ($F_{(1+2)}$) consisting of the yarns (1) having a high water-absorbing and self-elongating property and composite yarns (1+2) formed from the yarn (1) having a high water-absorbing and self-elongating property and the yarns (2) having a low water-absorbing and self-elongating property, whereby a plurality of regions formed by the intersection of the warp yarns ($W_{(1+2)}$) and the weft yarns ($F_{(1+2)}$), and having a high water-absorbing and self-elongating property, are arranged separately from each other in the warp and weft directions in the form of islands in a sea.

In another embodiment (2), the woven or knitted fabric of the present invention containing two different types of yarns has a two ply knitting structure including a cylinder side knit ply and a dial side knit ply, one of the two plies being tucked with the other ply, wherein the cylinder side knit ply is formed from the yarns (2) having a low water-absorbing and self-elongating property, and in the dial side knit ply, a plurality of regions formed from only the yarns (2) having a low water absorbing and self-elongating property and a plurality of regions formed from composite yarns constituted from the yarns (1) having a high water-absorbing and self-elongating property and the yarns (2) having a low water-absorbing and self-elongating property are arranged alternately with each other in the course and/or wale direction.

The embodiment (1) corresponds to the fabric shown in FIG. 6 (FIGS. 6-(A) and 6-(B)), while the embodiment (2) corresponds to the fabric shown in FIG. 7 (FIGS. 7-(A) and 7-(B)).

In a further embodiment (3), the woven or knitted fabric of the present invention containing two different types of yarns has a three ply knitting structure consisting of a cylinder side knit ply, a dial-side knit ply and an intermediate-knit ply interposed between both the former knit layers, in which structure either one of the intermediate knit ply and the cylinder side knit ply or the dial side knit ply is tucked with the other. The intermediate knit ply consists solely of the yarns (2) having a low water-absorbing and self-elongating property, and each of the dial side and cylinder side knit plies has regions formed solely from the yarns (2) having a low water-absorbing and self-elongating property and regions formed of composite yarns constituted from the yarns (1) having a high water-absorbing and self-elongating property and the yarns (2) having a low water-absorbing and self-elongating property. Those regions are alternately arranged with each other in the course direction and/or the wale direction.

In FIG. 8, one example of the knitting structure for the woven or knitted fabric of the present invention containing two different types of yarns corresponding to the above-mentioned embodiment (2) is shown. In this knitting structure, composite yarns (covered yarns) (a) consisting of core yarns formed from elastic polyether-ester multifilament yarns and sheath yarns formed from non-elastic polyester multifilament yarns wound around the core yarns, that is, composite covered yarns (a) formed from the yarns (1) and the yarns (2); and non-elastic polyester multifilament yarn (b) are used. In this knitting structure, through yarn feeders 1 to 15, the covered yarns (a) and yarn (b) are fed alternately with each other, and through feeders 16 to 24, the yarns (b) are solely fed. In the yarn feeders 1 to 15, the covered yarns (a) are used to form the dial side knit ply and the yarn (b) is used to form the cylinder side knit ply, while in the yarn feeders 16 to 24, the yarns (b) are used to form the dial and cylinder side knit plies wherein the dial side knit ply is tucked from the cylinder side knit ply. Thereby, in the regions of the resultant knitted fabric corresponding to the yarn feeders 1 to 15, the yarns (1) having a high water-absorbing and self-elongating property are distributed in the dial knit ply with a higher content than that in the other regions.

Signals in FIG. 8 represent the following:

1 to 24: yarn feeders

C: a cylinder side

D: a dial side a: a covered yarn formed from polyether-ester core yarns and polyester sheath yarns.

b: polyester yarn

O: a dial side knit x: a cylinder side knit

Ɣ: a cylinder side tuck

The woven or knitted fabric of the present invention is optionally subjected to a dyeing and/or finishing treatment. The dyeing treatment includes both of a dip dyeing work and a printing work. The finishing treatment may be applied to one or both surfaces of the fabric, and includes various function-imparting treatments such as a water-repellent treatment, an ultraviolet ray-shielding treatment, an anti-fungus treatment, a deodorization treatment, a moth-proofing treatment, a light-storage agent treatment, a retro-reflecting agent treatment, a negative ion generator treatment and others.

In the woven or knitted fabric of the present invention formed of two different types of yarns, preferably the fabric has a knitted fabric structure formed from the above-mentioned yarns (1) and (2), and the knitted fabric structure has a density satisfying the following equation:

$$Co \times We \geqq 2{,}000$$

wherein Co represents the number of courses per 2.54 cm in the transverse direction of the knitted fabric and Wo represents the number of wales per 2.54 cm in the longitudinal direction of the fabric. The value of Co×We is more preferably 2000 or more, further more preferably in the range of from 4,000 to 10,000.

If the value of Co×We is less than 2000, the air-permeability of the resultant fabric in the dry state may insufficiently reduce to deteriorate the wind shield property. Contrarily, if the value of Co×We is more than 10,000, the air-permeability of the resultant fabric in the wetted state may insufficiently increase.

There is no limitation to the knitting structure. For example, a warp knitting structure includes a half tricot structure, a satin structure, a plain tricot structure, a shark skin structure, a velvet structure, a queens cord structure, etc. A circular knitting structure includes a plain structure, a tuck structure, an interlock structure, a rib structure, a punch Rome structure, a milanese rib structure, etc. Among them, the half tricot and satin structures in the warp knitting structure and the plain and interlock structures in the circular knitting structure are preferably used due to the good wind-shield property. In this regard, there is no limitation to the number of plies of the knitted fabric; that is, it may be either a single-ply or a multiple-ply structure.

When the knitted fabric of the present invention, for example, a warp knitted fabric, is manufactured, by using a warp knitting machine having two or more reeds, for example, elastic polyetherester multifilament yarns are fed, as yarns (1), to back reeds while drafting (drawing) and the yarn (2) is fed to another reeds. In the resultant knitted fabric, the polyetherester multifilament yarns elastically recover (shrink) to shorten the length thereof, whereby a difference in length between the yarns (1) and (2) can be created.

When the knitted fabric of the present invention is manufactured, the value of Co is preferably 50 or more, more preferably in a range from 60 to 120. Also, the value We is preferably 40 or more, more preferably in a range from 50 to 80.

When the fabric of the present invention containing two different types of yarns has a weave structure comprising composite yarns or paralleled yarns consisting of at least one yarn (1) having a high water-absorbing and self-elongating property and at least one yarn (2) having a low water-absorbing and self-elongating property, which composite or paralleled yarns constitute either one of the warp and weft yarns, and the yarns (2) having a low water-absorbing and self-elongating property, from which yarns (2), another ones of the warp and weft yarns are constituted, a cover factor of the woven fabric is preferably in a range of from 1800 to 2800, more preferably from 2,300 to 2,700.

The cover factor CF is defined by the following equation:

$$CF=(DWp/1.1)^{1/2}\times MWp+(DWf/1.1)^{1/2}\times MWf$$

wherein DWp represents a total yarn thickness (dtex) of the warp yarns, DWp represents a weaving density (yarns/3.79 cm) of the warp yarns, DWf represents a total yarn thickness (dtex) of the weft yarns, and MWf represents a weaving density (yarns/3.79 cm) of the weft yarns.

There is no limitation to the number of the yarns (1) or (2) contained in the composite or paralleled yarns. Usually, the number of each of the yarns (1) and (2) may be one or more.

A favorable example of the composite yarns is a core-in-sheath type yarn or a covered yarn consisting of a core portion formed from one or more yarns (1) having a high water-absorbing and self-elongating property and a sheath portion formed from a plurality of yarns (2) having a low water-absorbing and self-elongating property and surrounding the core portion.

The composite yarn is manufactured by an air jet interlacing method, a Taslan air-jet method, a covering method, a composite false-twist texturing method, etc. Among them, the covering method wherein the yarns (1) having a high water-absorbing and self-elongating property are used as core yarns and the yarns (2) having a low water-absorbing and self-elongating property are wrapped around the core yarns, is used, the resultant composite yarns have a clear core-in-sheath structure which imparts a high stretchability to the composite yarn.

Figure 9:
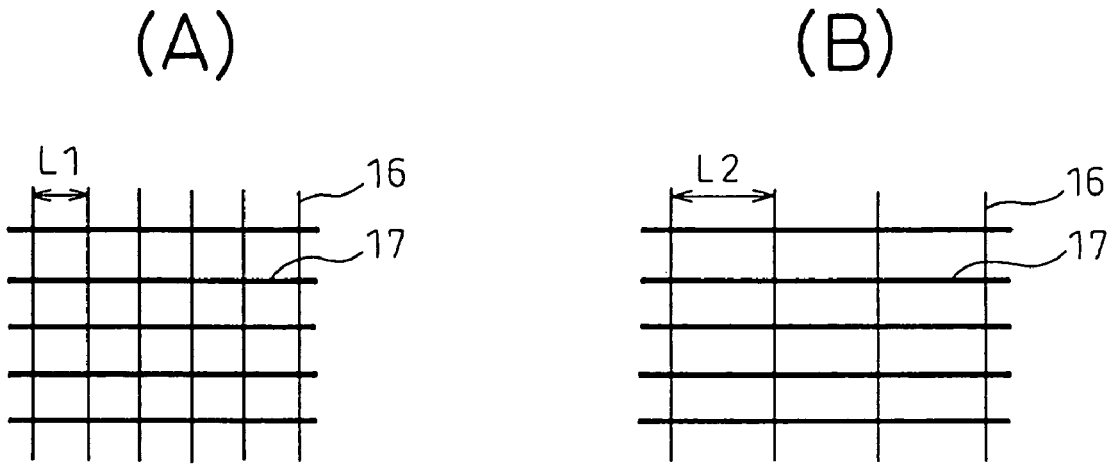
In FIG. 9, FIG. 9-(A) shows an explanatory plane view of a plain weave structure of a woven fabric, as another embodiment of the woven or knitted fabric of the present invention containing two different types of yarns in dry state, and FIG. 9-(B) shows an explanatory plane view of the plain weave structure as shown in FIG. 9-(A), upon being wetted with water.

FIG. 9 (FIGS. 9-(A) and 9-(B)) illustrates, as an example of the woven or knitted fabric of the present invention containing two different types of yarns, a weaving structure constituted from warp yarns 16 consisting of the yarns (2) having a low water-absorbing and self-elongating property and weft yarns 17 consisting of composite yarns constituted from core yarns formed from the yarns (1) having a high water-absorbing and self-elongating property and sheath yarns formed from the yarn (2) having a low water-absorbing and self-elongating property. When the above-mentioned fabric in a dry state as shown in FIG. 9-(A) absorbs water to after wetting, the yarns (1) in the composite yarns, from which the weft yarns 17 are constituted, absorb water and elongate, and therefore the weft yarns 17 elongate as a whole in the weft direction. Accordingly, a distance L1 between the adjacent warp yarns 16 in a dry state increases into L2, and as a result, the opening area between the yarns in the weaving structure increases to facilitate the air-permeability.

It is possible to manufacture clothing from the woven or knitted fabric of the present invention containing two different types of yarns, which clothings are capable of increasing the air-permeability by absorbing water.

The above-mentioned clothing may be underwear, for example, shirts, and sportswear, for example, trainers or sweaters.

Figure 10:
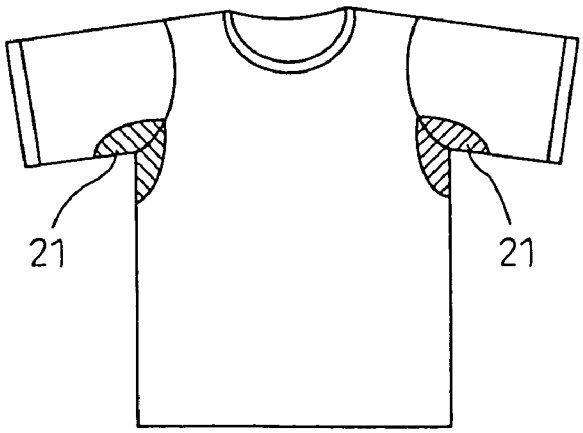
FIG. 10 shows an explanatory front view of an embodiment of clothing comprising the woven or knitted fabric of the present invention containing two different types of yarns.
Figure 11:
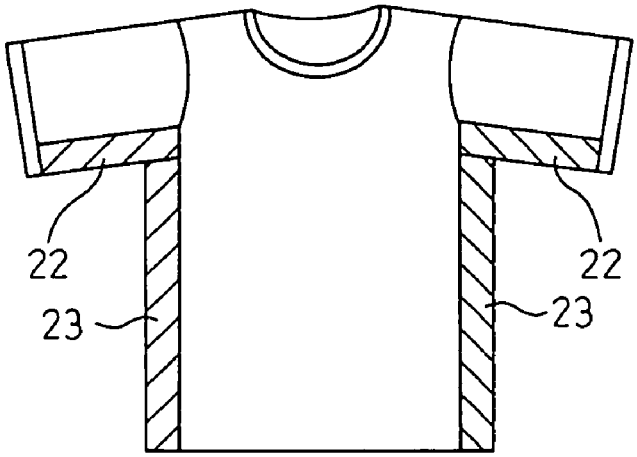
FIG. 11 shows an explanatory front view of another embodiment of clothing comprising the woven or knitted fabric of the present invention containing two different types of yarns.
Figure 12:
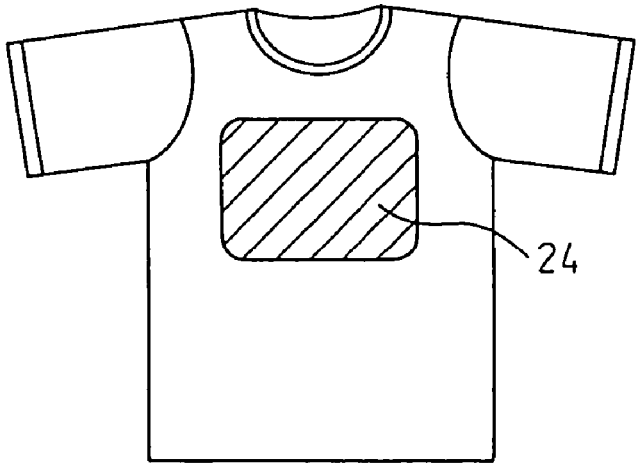
FIG. 12 shows an explanatory front view of another embodiment of clothing comprising the woven or knitted fabric of the present invention containing two different types of yarns.
Figure 13:
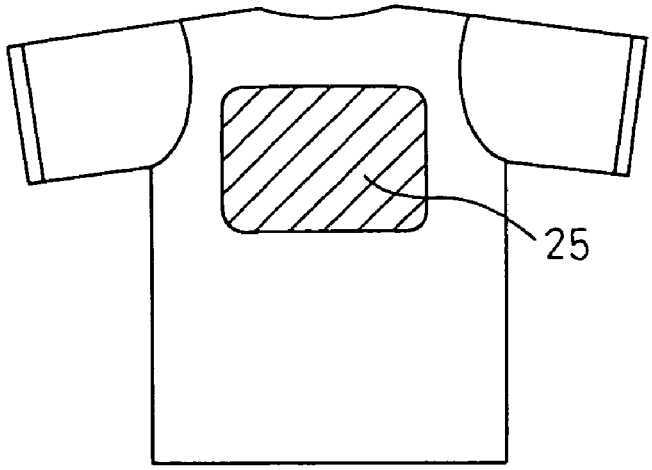
FIG. 13 shows an explanatory back view of another embodiment of clothing comprising the woven or knitted fabric of the present invention containing two different types of yarns.
Figure 14:
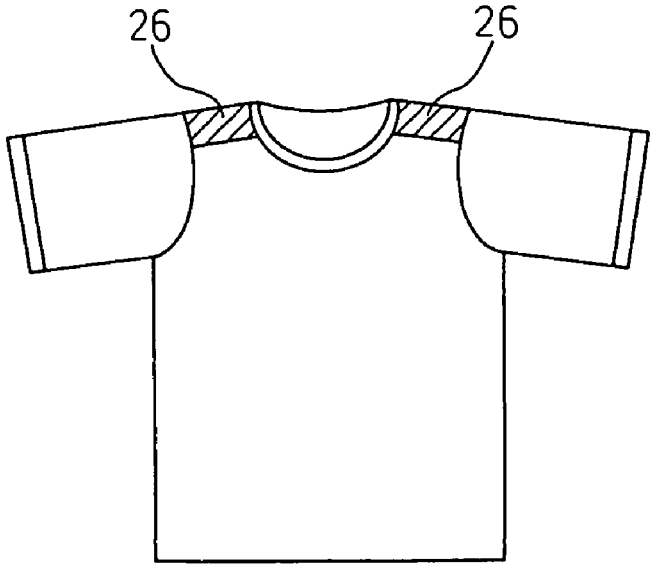
FIG. 14 shows an explanatory front view of another embodiment of clothing comprising the woven or knitted fabric of the present invention containing two different types of yarns.

The above-mentioned clothing may be totally or mainly formed from the woven or knitted fabric of the present invention containing two different types of yarns, or at least one part of the clothing selected from an armhole, a side, a breast, a back and a shoulder portions thereof may be formed of the woven or knitted fabric of the present invention containing two different types of yarns. In the latter case, most of the clothing is formed from a conventional woven or knitted fabric the air-permeability of which is not changed by the wetting, while at least one part thereof corresponding to body portions liable to sweat, namely, left and right armholes 21 shown in FIG. 10, left and right lower portions 22 of sleeves and left and right side portions as shown in FIG. 11, a center portion 24 of the breast as shown in FIG. 12, an upper middle portion 25 of a back as shown in FIG. 13 and left and right shoulder portion 26 as shown in FIG. 14 is formed from the woven or knitted fabric of the present invention containing two different types of yarns. A total area of the portions formed from the woven or knitted fabric of the present invention is preferably in the range of from 500 to 10,000 $cm^2$ and in a proportion to the total area of the clothing in a range from 5 to 70%, more preferably from 10 to 60%. If the proportion in area is less than 5%, the effect for facilitating the air-permeability in the wet portion becomes too low when the clothing is partially wetted by the sweating. Contrarily, if the area proportion is more than 70%, the change in dimension of the clothing may be too large, as a whole.

Figure 15A:
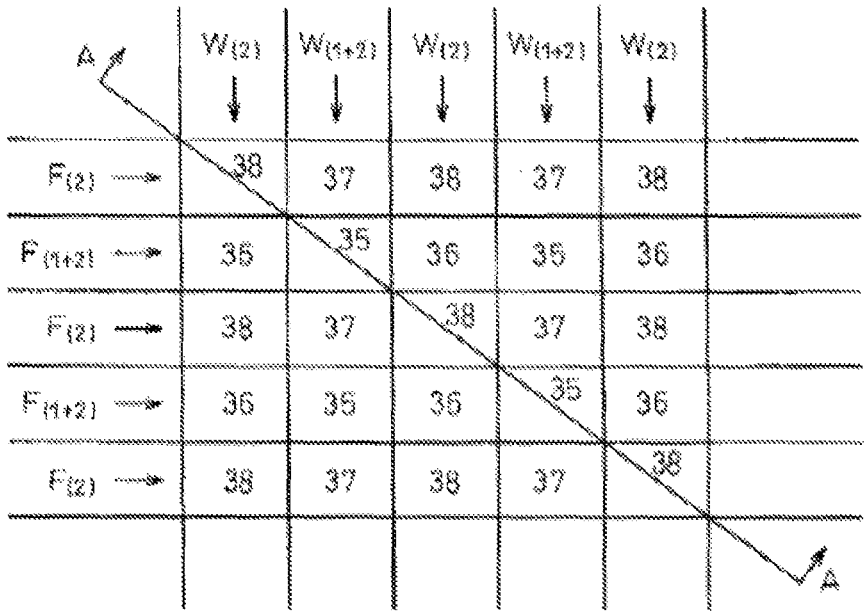
FIG. 15(A) shows a weave structure of a woven fabric of the present invention.
Figure 15B:
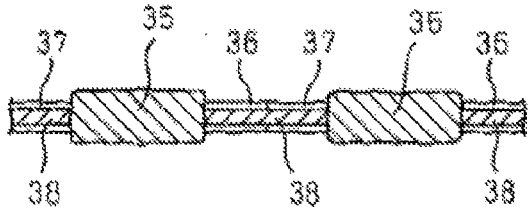
FIG. 15(B) shows an explanatory cross-sectional view of the woven fabric along a line A-A as shown in FIG. 15(A).

FIG. 15(A) shows a weave structure of an embodiment of the woven fabric of the present invention, and FIG. 15(B) shows an explanatory cross-sectional view of the woven fabric, as shown in FIG. 15(A), along the line A-A intersecting obliquely both the warp and weft directions of the woven fabric.

Referring to FIG. 15(A), a woven fabric 30 is formed from a plurality of warp yarn groups $W_{(2)}$ and a plurality of warp yarn group $W_{(1+2)}$ alternately arranged with each other and a plurality of weft yarn groups $F_{(2)}$ and a plurality of weft yarn groups $F_{(1+2)}$ alternately arranged with each other. Each of the warp yarn group $W_{(2)}$ and $W_{(1+2)}$ and the weft yarn group $F_{(2)}$ and $F_{(1+2)}$ consists of a plurality of individual yarns arranged in parallel to each other. The individual yarns of the warp yarn groups $W_{(1+2)}$ and the weft yarn group $F_{(1+2)}$ consist of composite or paralleled yarns each formed from yarns (1) having a high water-absorbing and self-elongating property and yarns (2) having a low water-absorbing and self-elongating property.

Also, the individual yarns of the warp yarn group $W_{(2)}$ and the weft yarn group $F_{(2)}$ each consist solely of a yarn (2) having a low water-absorbing and self-elongating property.

The individual warp yarns of the warp yarn groups $W_{(2)}$ and $W_{(1+2)}$ intersect the individual weft yarns of the weft yarn groups $F_{(2)}$ and $F_{(1+2)}$, to form the woven fabric 30. In the resultant woven fabric 30, a plurality of regions 35 are formed from the warp yarns $W_{(1+2)}$ and the weft yarns $F_{(1+2)}$ intersecting each other, and arranged separately from each other in the warp and weft directions in the form of islands in a sea. Referring to FIG. 15(A), in a plurality of regions 36, the warp yarns W m intersect the weft yarns $F_{(1+2)}$: in a plurality of regions 37, the warp yarns $W_{(1+2)}$ intersect the weft yarns $F_{(2)}$; and in a plurality of regions 38, the warp yarns $W_{(2)}$ inter sect the weft yarns $F_{(2)}$.

When the woven fabric 30 is wetted with water, as shown in FIG. 15(B), the yarns (1) in both the warp and weft yarn groups $W_{(1+2)}$ and $F_{(1+2)}$ located in the regions 35 absorb water and elongate, whereby the regions 35 bulge outside from the upper and/or lower surfaces of the woven fabric to form a plurality of convexities separated from each other in the warp and weft directions.

Figure 16A:
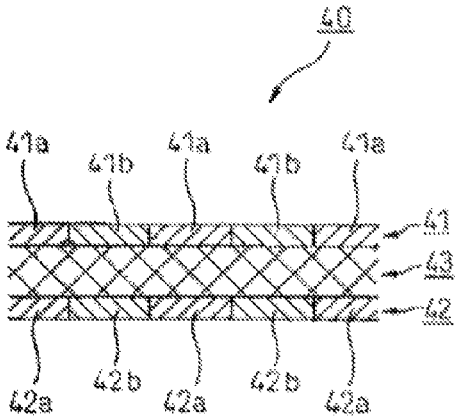
FIG. 16(A) shows an explanatory cross-sectional view of an embodiment of the knitted fabric of the present invention having a three-ply knitting structure and being in a dry state.
Figure 16B:
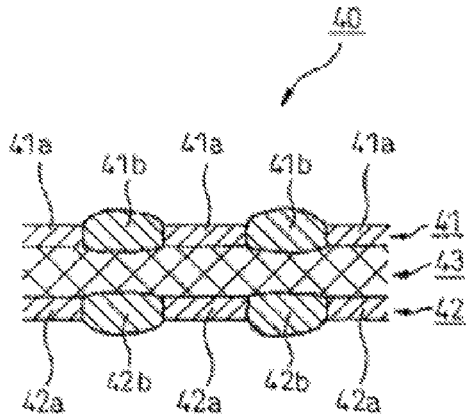
FIG. 16(B) shows an explanatory cross-sectional view of the knitted fabric as shown in FIG. 16(A) in a water-wetted condition.

FIG. 16(A) shows an explanatory cross-sectional view of another embodiment of the knitted fabric of the present invention having a three ply knitting structure and being in the dry stale, and FIG. 16(B) shows an explanatory cross-sectional view of the knitted fabric as shown in FIG. 16(A) in the water-wetted condition.

Referring to FIG. 16(A), a dry knitted fabric 40 has a triply knitted structure comprising a cylinder side knitted layer 41, a dial side knitted layer 42 and an intermediate knitted layer 43 arranged between the abovementioned cylinder and dial side knitted layers 41 and 42. Either one of the intermediate knitted layer 43 and the cylinder side knitted layer 41 are tucked from the other, and either one of the intermediate knitted layer 43 and the dial side knitted layer 42 are tucked from the other. No tucking structure is shown in FIG. 16(A). In the triply knitted structure, the intermediate knitted layer 43 is formed solely of the yarns (2) having a low water-absorbing, self-elongating property, and in the cylinder side and dial side knitted layers 41 and 42, regions 41*a* and 42*a* are formed from the yarns (2) having a low water-absorbing, self-elongating property and regions 41*b* and 42*b* are formed from composite yarns formed from the yarns (1) having a high water-absorbing, self-elongating property and the yarns (2) having a low water-absorbing, self-elongating property. In the cylinder side knitted layer 41, the regions 41*a* and 41*b* are arranged alternately with each other, and in the dial side knitted layer 42, the regions 42*a* and 42*b* are arranged alternately with each other, in course direction and/or wale direction.

When the knitted fabric 40 is wetted with water, in the cylinder and dial side knitted layers 41 and 42, the yarns (2) in the regions 41*b* and 42*b* absorb water and elongate to bulge the regions 41*b* and 42*b* outwardly, as shown in FIG. 16(B).

EXAMPLES

The present invention will be further explained with reference to the following examples which are not intended to limit the scope of the present invention in any way. In the examples, the measurements described below were carried out.

(1) Length of a Yarn in a Woven or Knitted Fabric in Dry and Wet States

Measurement was carried out by the method as described hereinbefore.

(2) Self-Elongation of Yarn

Measurement was carried out by the method as described hereinbefore.

(3) Shrinkage of Yarn in Boiling Water

Measurement was carried out in accordance with JIS L 1013-1998, 7.15. The number n of test pieces was 3.

(4) opening areas between yarns of woven or knitted fabric in dry and wet states and the change in the opening area.

Measurement was carried out by the method as described hereinbefore.

(5) Air-permeabilities of woven or knitted fabric in dry and wet states and the change in the air-permeability Measurement was carried out by the method as described hereinbefore.

(6) Thicknesses of concaves and convexes in woven or knitted fabric in dry and wet states and roughness and the change in roughness of the fabric.

Measurement was carried out by the method as described hereinbefore.

Example 1

A polyetherester polymer consisting of 49.8 parts by mass of hard segments formed from polybutylene terephthalate and 50.2 parts by mass of soft segments formed from polyoxyethylene glycol having a number-average molecular weight of 4,000 was melted at 230° C. and the resultant melt was extruded through a spinneret for spinning a monofilament at an extrusion rate of 3.05 g/min. Streams of this melt-extruded polymer were taken up through two godet rollers at a speed of 705 m/min and then wound at a speed of 750 m/min (so that a winding draft is 1.06), resulting in an elastic yarn (1) having a high water-absorbing and self-elongating property and a yarn count of 44 dtex/one filament. The self-elongation of this yarn (1) upon absorbing water was 10% in the axial direction of the filament, and the shrinkage thereof in boiling water was 8%.

Also, a conventional polyethylene terephthalate multifilament yarn (84 dtex/24 filaments) having a shrinkage of 10% in boiling water and a self-elongation of 1% or less in a wet state was used as a non-self-elongating yarn (2).

The yarn (1) and the yarns (2) was fed to a 28 gauge single circular knitting machine, while the yarn (1) was drafted at a draft of 50%, and the yarn (2) was not drafted, paralleled yarn was, to produce a circular knitted fabric having a plain knitting structure at densities of 47 courses/2.54 cm and 40 wales/2.54 cm. This circular knitted fabric was subjected to the dyeing and finishing treatments. In the resultant circular knitted fabric, circular knitted composite loops were formed from the yarns (1) and (2) as shown in FIG. 1-(A), and a ratio A/B in mean yarn length of the resultant knitted fabric was 0.7. The opening area between the yarns of the resultant circular knitted fabric was 15% in a dry state and 23% in a wet state, the change in opening area was 53%, the air-permeability of the fabric was 210 ml/cm$^2$ in a dry state and 380 ml/cm$^2$ in a wet state, and the change in air-permeability was 81%. In this circular knitted fabric, it was confirmed that the opening area increased and the air-permeability increased as the fabric absorbed water.

Example 2

A covered yarn (composite yarn) was produced from a core yarn consisting of the yarn (1) having a high water-absorbing and self-elongating property which is the same that as used in Example 1, and a sheath yarn consisting of the yarn (2) formed from polyethylene terephthalate multifilament (33 dtex/12 filaments) having a shrinkage of 10% in boiling water and a self-elongation of 1% in a wet state, at a draft of the core yarn of 30% (1.3 times), with the number of turnings of the sheath yarn of 350/m (in the Z direction). The covered yarn a and a polyethylene terephthalate multifilament yarn b (84 dtex/72 filaments) having a shrinkage in boiling water of 8% and a self-elongation of 1% or less were fed to a 24 gauge double circular knitting machine to produce a knitted fabric having a knitting structure as shown in FIG. 8 at densities of 38 courses/2.54 cm and 32 wales/2.54 cm. This knitted fabric was subjected to the dyeing and finishing treatment. A ratio A/B in mean yarn length of the resultant knitted fabric was 0.8.

A cross-sectional profile of the resultant knitted fabric in the thickness direction is illustrated in FIG. 7-(A) wherein a front surface ply is formed solely from the non-self-elongating yarn (2) (polyethylene terephthalate multifilament yarn b) and the back surface ply is formed from the covered yarn a (formed from the yarn (1) having a high water-absorbing and self-elongating property and the non-self-elongating yarn (2)), and regions having a highest content of the yarn (1) having a high water-absorbing and self-elongating property are not tucked with the front surface ply. A course-directional width of regions formed solely from the non-self-elongating yarn (2) in the back surface ply was approximately 7 mm and the course-directional width of regions containing the yarn (1) was approximately 7 mm.

The opening area of the resultant knitted fabric in dry state was 8% and the air-permeability thereof was 180 ml/cm$^2$.sec. When this fabric absorbed water, no change occurred in the dimensions thereof (length and width) as a whole. However, the regions formed of the covered yarn containing the yarn (2) bulged out from the back surface to form convexities. In the wet state, the opening area of this fabric was 10% (the change in the opening area was 25%) and the air-permeability was 240 ml/cm$^2$.sec (the change in the gap area was 33%).

Thicknesses of the convexities and concavities, the roughness and the change in roughness in the dry and wet test pieces of the fabric are shown in Table 1.

TABLE 1

| | Thickness H1 of convexities (mm) | Thickness H2 of concavities (mm) | Roughness (%) | Change in roughness (%) |
|---|---|---|---|---|
| Dry test piece | 0.88 | 0.81 | 8.7 | 51.5 |
| Wet test piece | 1.33 | 0.83 | 60.2 | |

It was confirmed that the knitted fabric of Example 2 exhibits a practically sufficient increase in opening area between yarns, air-permeability and a change in roughness between the dry and wet states.

Comparative Example 1

A knitted fabric having plain knitting structure and densities of 40 courses/2.54 cm and 35 wales/2.54 cm was produced from the same yarn (1) having a high water-absorbing and self-elongating property and the same non-self-elongating yarn (2) (polyethylene terephthalate multifilament yarn) as those used in Example 1 by using a 28 gauge single circular knitting machine while feeding both the yarns at the same speed as each other with no draft. The fabric was then subjected to the dyeing and finishing treatment. In the resultant circular knitted fabric, composite loops were formed from the yarns (1) and (2). The ratio A/B in mean yarn length of the yarn (1) to the yarn (2) was 1.0. Properties of this circular knitted fabric were as follows:

In the Dry State

Opening area: 30%

Air-permeability: 350 ml/cm$^2$.sec

In a Wet State

There are no changes in length and width of the fabric as a whole.

Opening area: 25% and change in opening area: −17%

Air permeability: 250 ml/cm$^2$.sec and change in air-permeability: −29%

The knitted fabric in Comparative example 1 did not exhibit the practically advantageous increase in the opening area between the yarns and air-permeability and the formation of convexities and concavities in the wet state.

Comparative Example 2

A knitted fabric was prepared in the same manner as in Example 2 and subjected to the dyeing and finishing operation, except that the covered yarn formed of the yarns (1) and (2) was replaced by a ply yarn produced by combining the yarn (1) with the yarn (2) and twisting the combined yarn with a doubling and twisting machine at a draft ratio of 0%. In the resultant circular knitted fabric, a ratio A/B in mean length of the yarn (1) to the yarn (2) was 1.0. This circular knitted fabric had the following properties:

In a Dry State

Opening area: 14%

Air-permeability: 230 ml/cm$^2$.sec

In a Wet State

There was no change in length and width of the fabric as a whole.

Opening area: 12%. change in opening area: −14%

Air-permeability: 190 ml/cm$^2$.sec, change in air-permeability: −17%

The circular knitted fabric of Comparative example 2 was practically unsatisfactory since the opening area and the air-permeability of the fabric did not increase and no convexity and concavity were formed in the fabric in a wet state.

Thicknesses of the convexities and concavities, the roughness and the change in roughness in the dry and wet test pieces of the resultant fabric are shown in Table 2.

TABLE 2

| | Thickness H1 of convexities (mm) | Thickness H2 of concavities (mm) | Roughness (%) | Change in roughness (%) |
|---|---|---|---|---|
| Dry test piece | 0.85 | 0.81 | 4.9 | 4.9 |
| Wet test piece | 0.90 | 0.82 | 9.8 | |

Example 3

The same polyetherester monofilament yarn (1) (44 dtex/1 filament) having a high water-absorbing and self-elongating property as that described in Example 1 was used.

As non-self-elongating yarn (2), a false-twist textured polyethylene terephthalate multifilament yarn (56 dtex/72 filaments) was used.

The yarns (1) were warped while being stretched at a draft of 100%, which yarns (1) were then fully set through back reeds of a 28 gauge tricot warp knitting machine, a warp and the yarns (2) were warped without drafting and then fully set through front reeds of the knitting machine, to produce a warp knitted fabric having a half tricot knitting structure (back: 10/12 and front: 23/10) and densities on machine of 90 courses/2.54 cm and 28 wales/2.54 cm. The knitted fabric was then subjected to the dyeing and finishing treatment. The densities of the resultant warp knitted fabric were 105 courses/2.54 cm and 58 wales/2.54 cm, and the ratio A/B in mean yarn length of the yarns (1) to the yarns (2) in the warp knitted fabric was 0.42. This warp knitted fabric had the following properties:

In a Dry State

Air-permeability: 35 ml/cm$^2$.sec

In a Wet State

Air-permeability: 87 ml/cm$^2$.sec, change in air-permeability: 149%

The above-mentioned warp knitted fabric exhibited an excellent wind-shielding property (low air-permeability) in the dry state, and a high air-permeability in the wet state.

Example 4

The same yarns (1) having a high water-absorbing and self-elongating property and non-self-elongating yarn (2) as those in Example 1 were used.

The yarn (1) was fed under a draft of 150% to a 28 gauge single circular knitting machine, together with the yarns (2) to produce a circular knitted fabric having a plain knitting structure and densities on machine of 92 courses/2.54 cm and 46 wales/2.54 cm. The fabric was then subjected to the dyeing and finishing treatment. The resultant circular knitted fabric had a densities of 106 courses/2.54 cm and 60 wales/2.54 cm, and a ratio A/B in mean yarn length of the yarns (1) to the yarns (2) was 0.54. The air-permeability of this circular knitted fabric was as follows:

In a Dry State

Air-permeability: 45 ml/cm$^2$.sec

In a Wet State

Air-permeability: 92 ml/cm$^2$.sec, change in air-permeability: 104%

The resultant circular knitted fabric exhibited an excellent wind-shielding property (low air-permeability) in a dry state, and a high air-permeability in a wet state.

Comparative Example 3

A warp knitted fabric having a circular interlock knitting structure with densities of 74 courses/2.54 cm and 61 wales/2.54 mm on machine was produced by the same procedures as in Example 3, except that the yarns (1) were fed together with the yarns (2) without drafting to a 36 gauge single circular knitting machine. This circular interlock fabric was subjected to the dyeing and finishing treatment.

The resultant circular knitted fabric had densities of 78 courses/2.54 cm and 75 wales/2.54 cm and a ratio A/B in yarn length of the yarns (1) to the yarns (2) of 0.98. The air-permeability of the circular knitted fabric was as follows:

In a Dry State

Air-permeability: 46 ml/cm$^2$.sec

In a Wetted State

Air-permeability: 31 ml/cm$^2$.sec

Change in air-permeability: −33%

The circular knitted fabric exhibited an excellent wind-shielding property (low air-permeability) in a dry state, but was unsatisfactory in air-permeability in a wet state.

Example 5

The same polyether-ester monofilament yarns (1) (44 dtex/1 filament) having a high water-absorbing and self-elongating property as that in Example 1 was used, except that the self-elongating property upon absorbing water of the yarns (1) was 25% and the shrinkage in boiling water thereof was 20%.

A polyethylene terephthalate false twist textured yarn (56 dtex/144 filaments, the shrinkage in boiling water of 10% and the self-elongating property upon absorbing water of 1% or less) was used as non-self-elongating yarns (2*a*).

The yarns (1) and (2*a*) were fed to a covered yarn-producing machine to produce a stretchable, elastic composite yarn (covered yarn) having a yarn count of 80 dtex/144 filaments. In the covered yarn production, the yarn (1) was used as core yarn and the yarn (2*a*) was used as a sheath yarn, the draft applied to the yarn (1) was 300%, the covering turn number of the yarn (2*a*) was 1000 turns/m in s direction. In the resultant composite yarn, the ratio A/B in means yarn length of the yarn (1) to the yarn (2*a*) was 0.29.

This composite yarn was used as a weft and a false twist-textured non-self-elongating polyethylene terephthalate multifilament yarn (2*b*) (the self-elongation upon absorbing water: 1% or less and 84 dtex/72 filaments) was used as a warp.

A plain weave fabric was produced from the yarn (2*b*) as warp and the composite yarn (the yarn (1)+the yarn (2*a*)) as weft at a warp density of 130 yarns/3.79 cm and a weft density of 126 yarns/3.79 cm, and subjected to the dyeing and finishing treatment. The resultant woven fabric had a cover factor CF of 2,400, and the air-permeability as shown below.

In a Dry State

Air-permeability: 3.8 ml/cm.sec

In a Wetted State

Air-permeability: 11.0 ml/cm$^2$.sec

Change in air-permeability: 189%

The above-mentioned plain weave fabric exhibited a high air-permeability in a wetted state which is practically satisfactory.

Example 6

A circular knitted fabric was prepared from the some yarns (1) having a high water-absorbing and self-elongating property and the some non-self-elongating yarn (2) as those in Example 1 by the same procedures as in Example 1.

Separately, a circular knitted fabric having a circular interlock structure with densities of 45 courses/2.54 cm and 41 wales/2.54 cm on machine was produced from a false twist-textured polyethylene terephthalate multifilament yarn (56 dtex/72 filaments; the self-elongation upon absorbing water: 1% or less) by using a 28 gauge double circular knitting machine of, and the resultant circular knitted fabric was subjected to the dyeing and finishing treatment. The change in air-permeability between dry and wet states of the knitted fabric was 5% or less. This circular knitted fabric was cut and sewn to produce a shirt with half length sleeve.

Left and right armhole portions of the shirt with half length sleeves (armhole portions 21 in FIG. 10) was cut and removed and, the armhole-removed shirt was re-assembled with the circular knitted fabric containing the yarns (1) and (2). The total area of the circular knitted fabric containing the yarns (1) and (2) used for the compensation was 1,050 cm which corresponds to 10% of a total area of the shirt with half length sleeves. The shirt with half length sleeves thus produced was subjected to a wearing test in which the wearers run to sweat. As a result, it was confirmed that this shirt is comfortable because the air-permeability of the left and right armhole portions is facilitated. Also, the change in dimensions of the shirt with half length sleeves due the sweating and wetting was not substantially recognized.

For the purpose of comparison, the same wearing test was carried out on a shirt with half length sleeves of which left and armhole portions were not cut and removed. As a result, when the left and right armhole portions were wetted with sweat, the feeling in wear became uncomfortable because the air-permeability was poor.

UTILIZABILITY IN INDUSTRY

The woven or knitted fabric of the present invention containing two different types of yarns capable of increasing the air-permeability upon wetting with water is useful as a clothing fabric, particularly for underwears or sportswears, because the air-permeability of the fabric increases upon wetting with water although the change in dimensions thereof is relatively small. Also, the woven or knitted fabric of the present invention containing two different types of yarns does need not include expensive conjugated fibers or special processed yarns, and thus is suitable for the practical use.

The invention claimed is:

1. A woven or knitted fabric containing yarns (1) having a high-water-absorbing and self-elongating property and yarns (2) having a low water-absorbing and self-elongating property, wherein (i) in the knitted fabric, the high water-absorbing and self-elongating yarns (1) and the low water-absorbing and self-elongating yarns (2) are combined in parallel with each other and the combined yarns form composite yarn loops in the fabric, and in the woven fabric, the high water-absorbing and self-elongating yarns (1) and the low-water absorbing and self-elongating yarns (2) are combined in parallel with each other, and the combined yarns form at least one of warps and wefts of the woven fabric, or the high water-absorbing and self-elongating yarns (1) and the low water-absorbing and self-elongating yarns (2) are formed into composite yarns or paralleled yarns, and the composite yarns or the paralleled yarns and the low water-absorbing and self-elongating yarns (2) are arranged alternately with every at least one yarn in at least one direction selected from the warp and weft directions of the woven fabric structure or in at least one direction selected from the wale and course directions of the knitted fabric structure, or at least one of the high water-absorbing and self-elongating yarns (1) is combined with at least one of the low water-absorbing and self-elongating yarns (2) to form a composite yarn, (ii) when the high water-absorbing and self-elongating yarns (1) and the low water-absorbing and self-elongating yarns (2) are respectively subjected to a measurement of self-elongating on absorbing water in such a manner that each of the yarns is wound 10 times around a reel for hank having a circumference of 1.125 m long under a load of 0.88 mN/dtex to form a hank; the hank is removed from the reel and left to stand in the air atmosphere having a temperature at 20 C and a relative humidity at 65% for 24 hours to dry the hank; then the length (Ld, mm) of the dry hank is measured under a load of 1.76 mN/dtex when the yarn is a non-elastic yarn having an elongation at break of 200% or less, or under a load of 0.0088 mN/dtex when the yarn is an elastic yarn having an elongation at break higher than 200%; the hank is immersed in water at a temperature at 20° C. for 5 minutes; then the hank is taken out from water; a length (Lw, mm) of the wet hank is measured under the same load as described above in response to the elongation at break of the hank; and the self-elongation of each yarn is calculated in accordance with the following equation:

$$\text{Self-elongation of yarn}(\%):[(Lw-Ld)/(Ld)]\times 100$$

one (1) of the two type of yarns is a high water-absorbing, self-elongating yarn having a mean self-elongation of +5% or more and the other (2) is a low water-absorbing, self-elongating yarn having a mean self-elongation lower than +5%;

(iii) the high water-absorbing, self-elongating yarns (1) are constituted from polyetherester monofilament formed from polyetherester elastomer comprising hard segments comprising polybutylene terephthalate blocks and soft segments consisting of polyoxyethylene glycol blocks having a number average molecular weight of 1,000 to 6,000; and the ratio by mass of the hard segments to the soft segments in the polyetherester elastomer is in the range of from 30/70 to 70/30; and (iv) when a test piece is prepared from the woven or knitted fabric in such a manner that the fabric is stabilized in dimension in the atmosphere having a temperature at 20° C. and a relative humidity at 65% and then cut into pieces of 30 cm long in the warp or wale direction and 30 cm long in the weft or course direction, and when high water-absorbing and self-elongating yarns (1) and low water-absorbing and self-elongating yarns (2) arranged in the same direction as that of the high water-absorbing and self-elongating yarns (1) in the test piece are picked up from the test piece, the high water-absorbing and self-elongating yarns (1) and the low water-absorbing and self-elongating yarns (2) satisfy the following requirement:

$$A/B \leqq 0.9$$

wherein A represents a mean length of the picked up high water-absorbing and self-elongating yarns (1) and B represents a mean length of the picked up low water-absorbing and self-elongating yarns (2) which have been arranged in the same direction as that of the high water-absorbing and self-elongating yarns (1) in the test piece, the length of each of the picked up yarns having been measured under a load of 1.76 mN/dtex when the yarn is a non-elastic yarn having an elongation at break of 200% or less or under a load of 0.0088 mN/dtex when the yarn is an elastic yarn having an elongation at break higher than 200%, and whereby the air-permeability of said woven or knitted fabric increases when wetted with water.

2. The woven or knitted fabric containing two different types of yarns as defined by claim 1, wherein the difference ($E_{(1)}$-$E_{(2)}$) between the self-elongation ($E_{(1)}$) upon absorbing water of the yarn (1) and the self-elongation ($E_{(2)}$) upon absorbing water of the yarn (2) is in a range of from 5 to 40%.

3. The woven or knitted fabric containing two different types of yarns as defined by claim 1, having a knitted fabric structure, in which the yarns (1) and (2) are combined in parallel with each other, and the combined yarns form composite yarn loops in the fabric.

4. The woven or knitted fabric containing two different types of yarns as defined by claim 1, having a woven fabric structure in which the yarns (1) and (2) are combined in parallel with each other, and the combined yarns form at least one of warps and wefts of the woven fabric.

5. The woven or knitted fabric containing two different types of yarns as defined by claim 1, wherein composite yarns or paralleled yarns are formed from the two types of yarns (1) and (2), and the composite yarns or paralleled yarns and the yarns (2) are arranged alternately with every at least one yarn in at least one direction selected from the warp and weft directions of the woven fabric structure or in at least one direction selected from the wale and course directions in the knitted fabric structure.

6. The woven or knitted fabric containing two different types of yarns as defined by claim 1, wherein at least one of the yarns (1) is combined with at least one of the yarns (2) to form a composite yarn.

7. A woven or knitted fabric containing two different types of yarns as defined by claim 1, wherein fibers from which the yarn (2) having a low water-absorbing and self-elongating property is constituted, are selected from polyester fibers.

8. A woven or knitted fabric containing two different types of yarns as defined by claim 1 wherein, when the fabric is subjected to a measurement of change in opening area of the fabric in such a manner that a plurality of test pieces of the woven or knitted fabric are left to stand in the air atmosphere having a temperature at 20° C. and a relative humidity at 65% for 24 hours to prepare a plurality of dry test pieces and, separately, a plurality of other test pieces of said woven or knitted fabric are immersed in water at a temperature at 20° C. for 5 minutes, then taken out from water, and sandwiched between a pair of filter papers under the pressure of 490 N/m$^2$ for one minute to remove water existing in the interstices between fibers in the test pieces to prepare a plurality of wet test pieces, surfaces of each of the dry and wet test pieces are observed by an optical microscope at a magnification of 20 and the opening areas of the dry and wetted test pieces are calculated in accordance with the following equation:

Opening area(%)=

[(total area of openings between yarns)/(observed area)]×100 then, a mean value of the measured opening areas of each of the dry and wetted test pieces are calculated and a change between the mean opening area of the wetted test pieces and the mean opening area of the dry test pieces was calculated in accordance with the following equation:

Change in opening area(%)=

[(mean opening area of wetted test pieces)−(mean opening area of dry test pieces)]/(mean opening area of dry test pieces)×100, the resultant change in the opening area is at least 10%.

9. A woven or knitted fabric containing two different types of yarns as defined by claim 1 wherein, when a plurality of test pieces of the woven or knitted fabric are left to stand in the air atmosphere having a temperature of 20° C. and a relative humidity of 65% for 24 hours to prepare a plurality of dry test pieces and, separately, a plurality of other test pieces of the woven or knitted fabric are immersed in water at a temperature of 20° C. for 5 minutes, taken out from water, and sandwiched between a pair of filter papers under the pressure of 490 N/m$^2$ for one minute to remove water existing in the interstices between fibers in the test piece to prepare a plurality of wet test pieces, air-permeabilities of the dry and wetted test pieces are measured in accordance with JIS L 1096-1998, 6.27.1, Method A (Frazir type method), and a mean air-permeability of the dry test pieces and a mean air-permeability of the wet test pieces are calculated from the measurement data, and the change in air-permeability is calculated in accordance to the following equation:

Change in air-permeability=

[(mean air-permeability of wetted test pieces)−(mean air-permeability of dry test pieces)]/(mean air-permeability of dry test pieces)×100, the resultant change in air-permeability is 30% or more.

10. A woven or knitted fabric containing two different types of yarns as defined by claim 1, having a change in roughness of at least 5%; determined in such a manner that a plurality of test pieces of the woven or knitted fabric are left to stand in the air atmosphere at a temperature of 20° C. at a relative humidity of 65% for 24 hours to prepare a plurality of dry test pieces and, separately, a plurality of other test pieces of the woven or knitted fabric are immersed in water at a temperature of 20° C. for 5 minutes, are taken out from water, and then are sandwiched between a pair of filter papers under the pressure of 490 N/m$^2$ for one minute to remove water existing in the interstices between fibers in the test pieces to prepare a plurality of wet test pieces, thickness (H1) of convexities and thickness (H2) of concavities formed in the woven or knitted fabric structure of each dry and wetted test pieces are measured, a roughness of each of the dry and wetted test pieces is calculated in accordance with the following equation:

Roughness(%)=

(thickness H1 of convexities)−(thickness H2 of concave portion)/(thickness H2 of concavities)×100 wherein the thickness H1 of the convexities is a mean thickness of a convexities having an area of 1 mm×1 mm and the thickness H2 of the concavities is a mean thickness of the concavities having an area of 1 mm×1 mm and located in an approximately center part between two convexities adjacent to the concavities in the warp or course direction thereof, and the change in roughness is calculated in accordance with the following equation:

Change in roughness=

[(roughness of wetted test piece)−(roughness of dry test piece)]/100.

11. A woven or knitted fabric containing two different types of yarns as defined by claim 1, having a woven fabric structure in which structure a warp yarn group $W_{(2)}$ consisting of a plurality of warp yarns, each formed solely from the yarns (2) having a low water-absorbing, self-elongating property and a warp yarn group ($W_{(1+2)}$) consisting of a plurality of warp yarns, each formed of a composite yarn or a paralleled yarn formed from the yarns (1) having a high water-absorbing, self-elongating property and the yarns (2) having a low water-absorbing, self-elongating property, are alternately arranged with each other and the warp yarn groups intersect a weft yarn group $F_{(2)}$ consisting of a plurality of weft yarns, each formed solely from the yarns (2) having a low water-absorbing, self-elongating property, and a weft yarn group ($F_{(1+2)}$) consisting of a plurality of well yarns, each formed from composite yarns formed from the yarns (1) having a high water-absorbing, self-elongating property and the yarns (2) having a low water-absorbing, self-elongating property, whereby a plurality of regions having a high water-absorbing and self-elongating property and formed by the intersection of the warp group ($W_{(1+2)}$) and the well group ($F_{(1+2)}$), are arranged with spaces from each other both in the warp and well directions, in the form of islands in sea.

12. A woven or knitted fabric containing two different types of yarns as defined by claim 1, having a double knitted structure comprising a cylinder side knitted layer and a dial side knitted layer tucked from either one of said layers to the other, wherein the cylinder side knitted layer is formed from the yarns (2) having a low water-absorbing, self-elongating property, and in the dial side knitted layer, regions composed solely of the yarns (2) having a low water-absorbing, self-elongating property and regions composed of composite yarns, each formed of the yarn (1) having a high water-absorbing, self-elongating property and the said yarn (2) having a low water-absorbing, self-elongating property, are arranged alternately with each other in the course direction and/or the wale direction.

13. A woven or knitted fabric, containing two different types of yarns as defined by claim 1, having a triply knitted structure comprising a cylinder side knitted layer, a dial side knitted layer and an intermediate knitted layer disposed between the above-mentioned two layers; either one of the intermediate layer and the cylinder side knitted layer or the dial side knitted layer being tucked from the other, wherein the intermediate knitted layer is formed solely of the yarns (2) having a low water-absorbing, self-elongating property, and in each of said dial side and cylinder side knitted layers, regions composed solely of the yarns (2) having a low water-absorbing, self-elongating property and regions composed of composite yarns, each formed of the yarn (1) having a high water-absorbing, self-elongating property and the yarn (2) having a low water-absorbing, self-elongating property, are alternately arranged with each other in the course direction and/or the wale direction.

14. A woven or knitted fabric containing two different types of yarns as defined by claim 1, having a knitted fabric structure formed from of the two types of yarns (1) and (2), wherein the knitted fabric structure has a yarn density satisfying the following equation:

$$Co \times We \geqq 2{,}000$$

wherein Co represents the number of courses per 2.54 cm in the transverse direction of said knitted fabric, and We represent the number of wales per 2.54 cm in the longitudinal direction of said knitted fabric.

15. A woven or knitted fabric, containing two different types of yarns as defined by claim 1, having an air-permeability of 50 ml/cm$^2$.sec or less, determined in accordance with JIS L 1096-1998, 6.27.1, Method A (Frazir type method), in the air atmosphere having a temperature of 20° C. and a relative humidity of 65%.

16. A woven or knitted fabric, containing two different types of yarns as defined by claim 1, having a woven fabric structure in which one of warp and weft of the fabric is formed from composite or paralleled yarns, each formed from at least one yarn having a high water-absorbing, self-elongating property and at least one yarn having a low water-absorbing, self-elongating property, and the other one of warp and weft is formed from the yarns having a low water-absorbing, self-elongating property, and further exhibiting a cover factor CF in the range of from 1,800 to 2,800, determined in accordance with the following equation:

$$CF=(DWp/1.1)^{1/2}\times MWp+(DWf/1.1)^{1/2}\times MWf$$

wherein DWp represents a total yarn thickness (dtex) of the warp yarns, MWP represents a weaving density (yarns/3.79 cm) of the warp yarns, DWf represents a total yarn thickness (dtex) of the weft yarns, and MWf represents a weaving density (yarns/3.79 cm) of the weft yarns.

17. A woven or knitted fabric containing two different types of yarns as defined by claim 16, wherein the composite yarn comprises a core portion formed from at least one yarn having a high water-absorbing, self-elongating property and a sheath portion surrounding the core portion and formed from a plurality of yarns having a low water-absorbing, self-elongating property.

18. Clothing comprising the woven or knitted fabric containing two different types of yarns as defined by claim 1, and capable of increasing the air-permeability thereof upon absorbing water.

19. Clothing as defined by claim 18, wherein at least one portion of said clothing selected from an armhole, a side, a bust, a back and a shoulder is formed from the woven or knitted fabric containing two different yarns.

20. Clothing as defined by claim 18, selected from underwear.

21. Clothing as defined by claim 18, selected from sportswear.

* * * * *